US008104535B2

(12) United States Patent
Sierra et al.

(10) Patent No.: US 8,104,535 B2
(45) Date of Patent: Jan. 31, 2012

(54) METHOD OF IMPROVING WATERFLOOD PERFORMANCE USING BARRIER FRACTURES AND INFLOW CONTROL DEVICES

(75) Inventors: Leopoldo Sierra, Kissimmee, FL (US); Loyd E. East, Jr., Tomball, TX (US); Mohamed Y. Soliman, Cypress, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 238 days.

(21) Appl. No.: 12/583,441

(22) Filed: Aug. 20, 2009

(65) Prior Publication Data

US 2011/0042083 A1 Feb. 24, 2011

(51) Int. Cl.

| | |
|---|---|
| ***E21B 34/06*** | (2006.01) |
| ***E21B 43/16*** | (2006.01) |
| ***E21B 43/26*** | (2006.01) |
| ***E21B 47/10*** | (2006.01) |

(52) U.S. Cl. ..... 166/245; 166/50; 166/252.1; 166/270; 166/271; 166/281; 166/369; 166/373

(58) Field of Classification Search ..... None
See application file for complete search history.

(56) References Cited

U.S. PATENT DOCUMENTS

| | | | |
|---|---|---|---|
| 3,878,884 | A | 4/1975 | Raleigh |
| 4,390,067 | A | 6/1983 | Willman |
| 4,476,932 | A | 10/1984 | Emery |
| 5,025,859 | A | 6/1991 | Hanson et al. |
| 5,074,360 | A | 12/1991 | Guinn et al. |
| 5,183,109 | A | 2/1993 | Poulsen |
| 5,249,628 | A | 10/1993 | Surjaatmadja |
| 5,325,923 | A | 7/1994 | Surjaatmadja et al. |
| 5,396,957 | A | 3/1995 | Surjaatmadja et al. |
| 5,499,678 | A | 3/1996 | Surjaatmadja et al. |
| 5,533,571 | A | 7/1996 | Surjaatmadja et al. |
| 5,765,642 | A | 6/1998 | Surjaatmadja |
| 6,047,773 | A | 4/2000 | Zeltmann et al. |
| 6,095,244 | A | 8/2000 | Graham et al. |
| 6,112,817 | A | 9/2000 | Voll et al. |
| 6,119,776 | A | 9/2000 | Graham et al. |
| 6,167,966 | B1 | 1/2001 | Ayasse et al. |
| 6,328,104 | B1 | 12/2001 | Graue |

(Continued)

OTHER PUBLICATIONS

SPE 84077 "Toe-To-Heel Waterflooding. Part II: 3D Laboratory Test Results" by Alex Turta, et al., Oct. 2003.

(Continued)

*Primary Examiner* — George Suchfield
(74) *Attorney, Agent, or Firm* — Robert A. Kent; Misley PC

(57) ABSTRACT

The present invention is directed to a method of hydrocarbon production from a hydrocarbon reservoir. The method includes providing a substantially horizontal wellbore having at least one productive interval within a hydrocarbon reservoir and forming at least one non-conductive transverse fracture in the reservoir along the substantially horizontal wellbore. An injection well is also provided. A fluid is injected into the reservoir through the injection well to displace hydrocarbons within the reservoir toward a production portion of the substantially horizontal wellbore. Hydrocarbons are drained from the reservoir into at least one production interval of the substantially horizontal wellbore. Fluid production from the at least one production interval into the substantially horizontal wellbore flows through an inflow control device that can restrict the fluid flow. A non-conductive transverse fracture can form a barrier within the reservoir to divert injected fluids to increase sweep efficiency and reduce the influx of injected fluids into the production interval.

23 Claims, 26 Drawing Sheets

U.S. PATENT DOCUMENTS

| | | | | |
|---|---|---|---|---|
| 6,364,015 | B1 | 4/2002 | Upchurch | |
| 6,585,040 | B2 | 7/2003 | Hanton et al. | |
| 6,662,874 | B2 | 12/2003 | Surjaatmadja et al. | |
| 6,814,141 | B2 | 11/2004 | Huh et al. | |
| 6,883,613 | B2 * | 4/2005 | Bode et al. | 166/373 |
| 6,938,690 | B2 | 9/2005 | Surjaatmadja | |
| 7,228,908 | B2 | 6/2007 | East, Jr. et al. | 166/308.2 |
| 2006/0118305 | A1 * | 6/2006 | East et al. | 166/308.2 |
| 2007/0284107 | A1 * | 12/2007 | Crichlow | 166/302 |
| 2009/0101354 | A1 * | 4/2009 | Holmes et al. | 166/373 |
| 2009/0301730 | A1 * | 12/2009 | Gweily | 166/369 |

OTHER PUBLICATIONS

Halliburton Technical Brochure entitled "Cobra Jet Frac$^{SM}$ Service", undated.

C.E. Austin, et al.; Simultaneous Multiple Entry Hydraulic Fracture Treatments of Horizontally Drilled Wells; 63rd Annual Technical Conference and Exhibition of the Society of Petroleum Engineers; Houston, Texas (Oct. 2-5, 1988); SPE 18263.

M.A. Emanuele, et al.; A Case History: Completion and Stimulation of Horizontal Wells With Multiple Transverse Hydraulic Fractures in the Lost Hills Diatomite; 1998 SPE Western Regional Meeting; Bakersfield, California (May 10-13, 1998); SPE 46193.

M.R. Norris, et al.; Multiple Proppant Fracturing of Horizontal Wellbores in a Chalk Formation: Evolving the Process in the Valhall Field; 1998 SPE European Petroleum Conference; The Hague, The Netherlands (Oct. 20-22, 1998); SPE 50608.

J.B. Surjaatmadja, et al.; Hydrajet Fracturing: An Effective Method for Placing Many Fractures in Openhole Horizontal Wells; 1998 SPE International Conference and Exhibition in China; Beijing, China (Nov. 2-6, 1998): SPE 48856.

B.W. McDaniel, et al.; Limited-Entry Frac Applications on Long Intervals of Highly Deviated or Horizontal Wells; 1999 SPE Annual Technical Conference and Exhibition; Houston, Texas (Oct. 3-6, 1999); SPE 56780.

T.J. Love, et al.; "Selectively Placing Many Fractures in Openhole Horizontal Wells Improves Production," SPE Paper 50422, 1998.

Halliburton Technical Brochure entitled "Cobra Frac$^{SM}$ Service", 2000.

K.A. Edwards, et al.; Horizontal Injectors Rejuvenate Mature Miscible Flood—South Swan Hills Field; Revised for Publication From SPE 70066, First Presented at the 2001 SPE Permian Basin Oil and Gas Recovery Conference; Midland, Texas (May 15-16, 2001); SPE 77302.

Y. Bigno, et al.; Multilateral Waterflood Development of a Low-Permeability Carbonate Reservoir; 2001 SPE Annual Technical Conference and Exhibition; New Orleans, Louisiana (Sep. 30-Oct. 3, 2001); SPE 71609.

PL. McGuire, et al.; Unconventional Miscible FOR Experience at Prudhoe Bay; A Project Summary; Revised for Publication From SPE 72107, First Presented at the 2001 SPE Asia Pacific Improved Oil Recovery Conference; Kuala Lumpur (Oct. 8-9, 2001); SPE 82140.

Halliburton Technical Brochure entitled "Surgifrac$^{SM}$ Service", 2002.

W.A. Minner, et al.; Waterflood and Production-Induced Stress Changes Dramatically Affect Hydraulic Fracture Behavior in Lost Hills Infill Wells; SPE Annual Technical Conference and Exhibition; San Antonio, Texas (Sep. 29-Oct. 2, 2002); SPE 77536.

B.W. McDaniel, et al.; "Evolving New Stimulation Process Proves Highly Effective in Level 1 Dual-Lateral Completion," SPE Paper 78697, Oct. 23, 2002.

B.W. McDaniel, et al.; Overview of Stimulation Technology for Horizontal Completions Without Cemented Casing in the Lateral; SPE Asia Pacific Oil and Gas Conference and Exhibition; Melbourne, Australia (Oct. 8-10, 2002); SPE 77825.

A. Bryce Cunningham, et al.; Field Testing and Study of Horizontal Water Injectors in Increasing Ultimate Recovery From a Reservoir in Thamama Formation in a Peripheral Water Injection Scheme in a Giant Carbonate Reservoir, United Arab Emirates; Abu Dhabi International Petroleum Exhibition & Conference (Oct. 13-16, 2002); SPE 78480.

Gutierrez, O.D. Alter, et al.; Using Multilateral Well Technology to Improve Recovery Factor by Water Flooding in a Giant Mature Oil Field in Venezuela Lagunilla Inferior (LL-03); 2002 SPE International Thermal Operations and Heavy Oil Symposium and International Horizontal Well Technology Conference; Calgary, Alberta, Canada (Nov. 4-7, 2002); SPE/Petroleum Society of CIM/CHOA 78955.

Alex Turta, et al.; Toe-To-Heel Waterflooding. Part II: 3D Laboratory Test Results; SPE Annual Technical Conference and Exhibition; Denver, Colorado (Oct. 5-8, 2003); SPE 84077.

Geirmund Saetre; Proactive Breakthrough Prevention; Hart's E&P Magazine; www.epmag.com; published Jan. 5, 2009.

Halliburton Technical Brochure entitled "Swell Technology TM System", 2009.

* cited by examiner

Replacement Sheet
Fig. 1
-prior art-
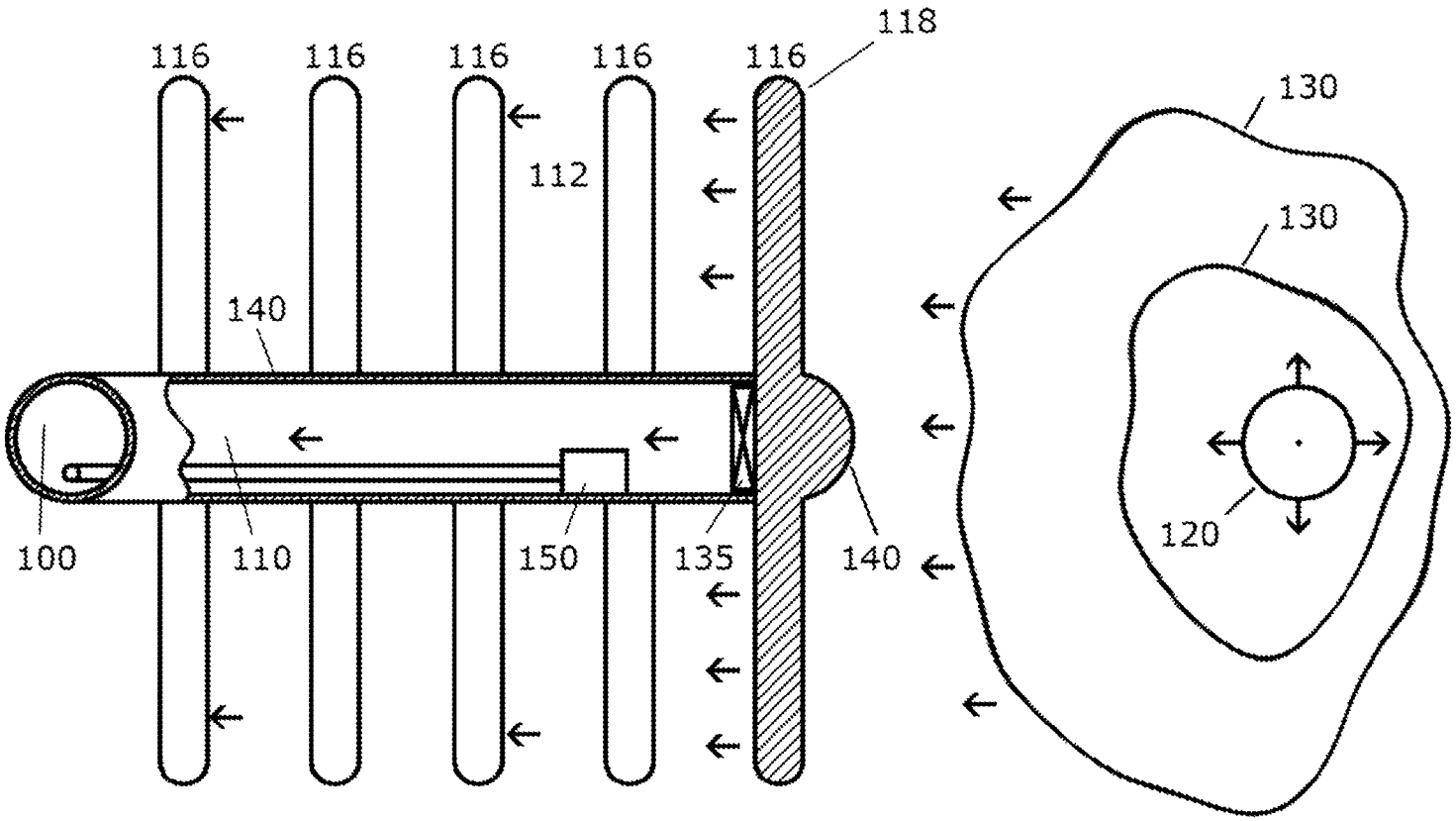

Map of Single Horizontal Producer with Single Vertical Injector

Scenario 1

Scenario 2

Scenario 3

Scenario 4

Scenario 5

Scenario 6

Map of Dual Parallel Horizontal Producers with Single Transversely Oriented Horizontal Injector Scenario 7

Scenario 8

Scenario 9

Scenario 10

METHOD OF IMPROVING WATERFLOOD PERFORMANCE USING BARRIER FRACTURES AND INFLOW CONTROL DEVICES

FIELD OF THE INVENTION

The present invention relates generally to hydrocarbon production, and more particularly to a method of increasing hydrocarbon recovery from a reservoir.

BACKGROUND OF THE INVENTION

In certain subterranean formations, fluid is injected into the reservoir to displace or sweep the hydrocarbons out of the reservoir. This method of production is generally referred to as a method of "Enhanced Oil Recovery" which may be water-flooding, gas injection, steam injection, etc. For the purpose of this specification, the general process will be defined as injecting a fluid (gas or liquid) into a reservoir in order to displace the existing hydrocarbons into a producing well. The primary issue with injecting fluid to enhance oil recovery is how to sweep the reservoir of the hydrocarbon in the most efficient manner possible. Because of geological differences in a reservoir, the permeability may not be homogenous. Because of such permeability differences between the vertical and horizontal directions or the existence of higher permeability streaks, the injecting fluid may bypass some of the reservoir fluid and create a path into the producing well. Even with homogenous reservoirs, the tendency of the injected fluid is to breakthrough into the producing well and consequently leave a large volume of the reservoir unswept by the injecting fluid. This problem generally gets worse as the mobility ratio between the fluids becomes unfavorable, such as when the mobility of the injected fluid is significantly higher than the reservoir fluid.

The industry has come up with numerous methods to improve the sweep efficiency and the overall reservoir that is swept by individual wells. These methods include fracturing and the use of horizontal wells. The industry currently uses horizontal wells as injectors in an attempt to expose more of the reservoir to the injecting fluid. The goal is to create a movement of injection fluid evenly across the reservoir. This is done to emulate the highly efficient line drive. The industry also uses horizontal wells as producers, again the goal being to evenly produce the reservoir so to form a line drive.

SPE Paper 84077 presents a method referred to as toe-to-heel waterflooding where a horizontal lateral is used to produce the reservoir with a vertical injector located nearer the toe (end) of the lateral. The method referred to in this paper is limited, since the horizontal lateral only covers a limited area in the reservoir. A horizontal lateral covers a small area in the vertical direction, thus the vertical sweep efficiency is fairly low. It therefore does not maximize the amount of surface area that can be used to recover the hydrocarbons. This method also suffers from an inability to control the influx of injection fluid at the toe to improve recovery.

Part of the efficiency of the sweep is reducing the production of the injection fluid. The industry has created several techniques from the use of chemicals that block the injection fluid, to injection fluids that improve the matrix flow through the reservoir to reduce channeling. Some injection programs include attempts to plug high permeability streaks and natural fractures in the reservoir. This is done to shut-off pathways that can exist between the injector well and producing wells. As these pathways are restricted the injection fluid will develop new pathways to the producing wells. This will force the injection fluid into more of the reservoir to displace hydrocarbons, thus improving sweep efficiency and reducing the influx of injected fluid into the producing wells.

When the injection fluid is produced, such as water, it is usually removed from the hydrocarbons at the surface using multi-phase separation devices. These devices operate to agglomerate and coalesce the hydrocarbons, thereby separating them from the water. A drawback of this approach, however, is that no separation process is perfect. As such, some amount of the hydrocarbons always remains in the water. This can create environmental problems when disposing of the water, especially in off-shore applications. Also, the multi-phase separation devices are rather large in size, which is another disadvantage in off-shore applications, as space is limited. Yet another drawback is that these devices can require additional maintenance or repair if solids are part of the produced fluid stream. A further, and perhaps greatest drawback of these solutions, is that they do nothing to increase or maximize the amount of hydrocarbons being produced. Their only focus is removing the water from the production.

Specialized downhole tools have also been developed, which separate the water from the hydrocarbons downhole. These tools are designed to re-inject the water into some designated formation as the hydrocarbons are produced. While these devices can remove a significant amount of water from the hydrocarbons, their efficiency are usually low. They also suffer from the same drawback of the surface separation devices in that they do nothing to increase or maximize the amount of hydrocarbons being produced.

A solution is therefore desired that not only improves the efficiency and economics of enhanced oil recovery through injection, but that also reduces the amount of injection fluid that infiltrates the hydrocarbon production of an existing well.

SUMMARY OF THE INVENTION

An embodiment of the present invention is directed to a method of hydrocarbon production from a hydrocarbon reservoir. The method includes providing a substantially horizontal wellbore within a hydrocarbon reservoir having at least one productive interval and forming at least one transverse non-conductive fracture, in the reservoir along the substantially horizontal wellbore. An injection well is also provided. A non-conductive fracture can be created adjacent the producer well to create a sealed transverse fracture that forms a barrier within the reservoir to divert non-hydrocarbon fluids away from the production intervals of the substantially horizontal wellbore. A fluid is injected into the reservoir through the injection well to displace hydrocarbons within the reservoir toward the producing well. Hydrocarbons are drained from the reservoir into the substantially horizontal wellbore. Fluid production flows through an inflow control device (ICD) that can restrict the fluid flow and distribute the drawdown pressure optimally along the horizontal wellbore. There can be more than one substantially horizontal wellbore, each can have multiple non-conductive and conductive transverse fractures. The injection well can be a horizontal well.

The non-conductive transverse fracture can be placed during the well construction, after initial production has begun or at any time during the life of the well. A non-conductive transverse fracture(s) can form a barrier(s) within the reservoir to divert injected fluids to increase sweep efficiency and reduce the influx of injected fluids into the production intervals.

The inflow control device(s) can provide an increasing pressure drop along the horizontal wellbore as the volume of fluid flow through the device increases. The inflow control device(s) can provide an optimized pressure drop in the reservoir along the productive horizontal lateral through the inflow control device for the designed volume of fluid flow through the device. The method can further comprise the selective closing or sealing of an inflow control device when production through the inflow control device reaches an unacceptable level of non-hydrocarbon fluids with the hydrocarbon production.

Additional inflow control devices can be selectively closed or sealed when production from the production interval associated with such inflow control devices reach an unacceptable level of non-hydrocarbon fluids with the hydrocarbon production.

The inflow control device can be a valve device, referred to as an inflow control valve (ICV), which can be closed. The inflow control device can include a sliding sleeve device that can be closed or sealed when production associated with such inflow control devices reach an unacceptable level of non-hydrocarbon fluids. Additional sliding sleeves not associated with an inflow control device can be incorporated with the substantially horizontal wellbore. The additional sliding sleeves can be used to create subsequent transverse fractures, such as non-conductive transverse fractures, that can be used as barrier fractures between productive intervals. Alternately a sliding sleeve having multiple ports can be used. A multi-port sliding sleeve can utilize one port for the creation of substantially transverse fractures, which can be closed after the fracture operation is completed. A second port can then be opened which allows production through an ICD. After production through the ICD reaches unacceptable level of non-hydrocarbon fluids, the second port can then be closed.

A further embodiment of the present invention is a method of designing a hydrocarbon production system that includes determining the stress field within a hydrocarbon reservoir, designing at least one horizontal well in the direction of the minimum horizontal stress and designing a plurality of fractures transverse to the wellbore. The design includes at least one injection well within the hydrocarbon reservoir and a reservoir model that incorporates the physical and mechanical properties of the reservoir and the stress field magnitude and orientation. The reservoir model is designed to incorporate the distance from the tip of the horizontal well to the injection well, number and location of the plurality of fractures transverse to the wellbore, number of inflow control devices, number of inflow control valves, injection rate of flood fluid, location of the injection interval. The model can be verified and built into a reservoir simulator. The parameters are varied to optimize the hydrocarbon production system design for the hydrocarbon reservoir.

BRIEF DESCRIPTION OF DRAWINGS

FIG. 1 is a schematic diagram illustrating prior art wherein one transverse fracture in a substantially horizontal wellbore is at least partially sealed creating a non-conductive barrier and fluid injected from a separate injection well is diverted around the non-conductive barrier fracture to improve sweep of the hydrocarbons into the horizontal producing well.

DETAILED DESCRIPTION

Figure 2:
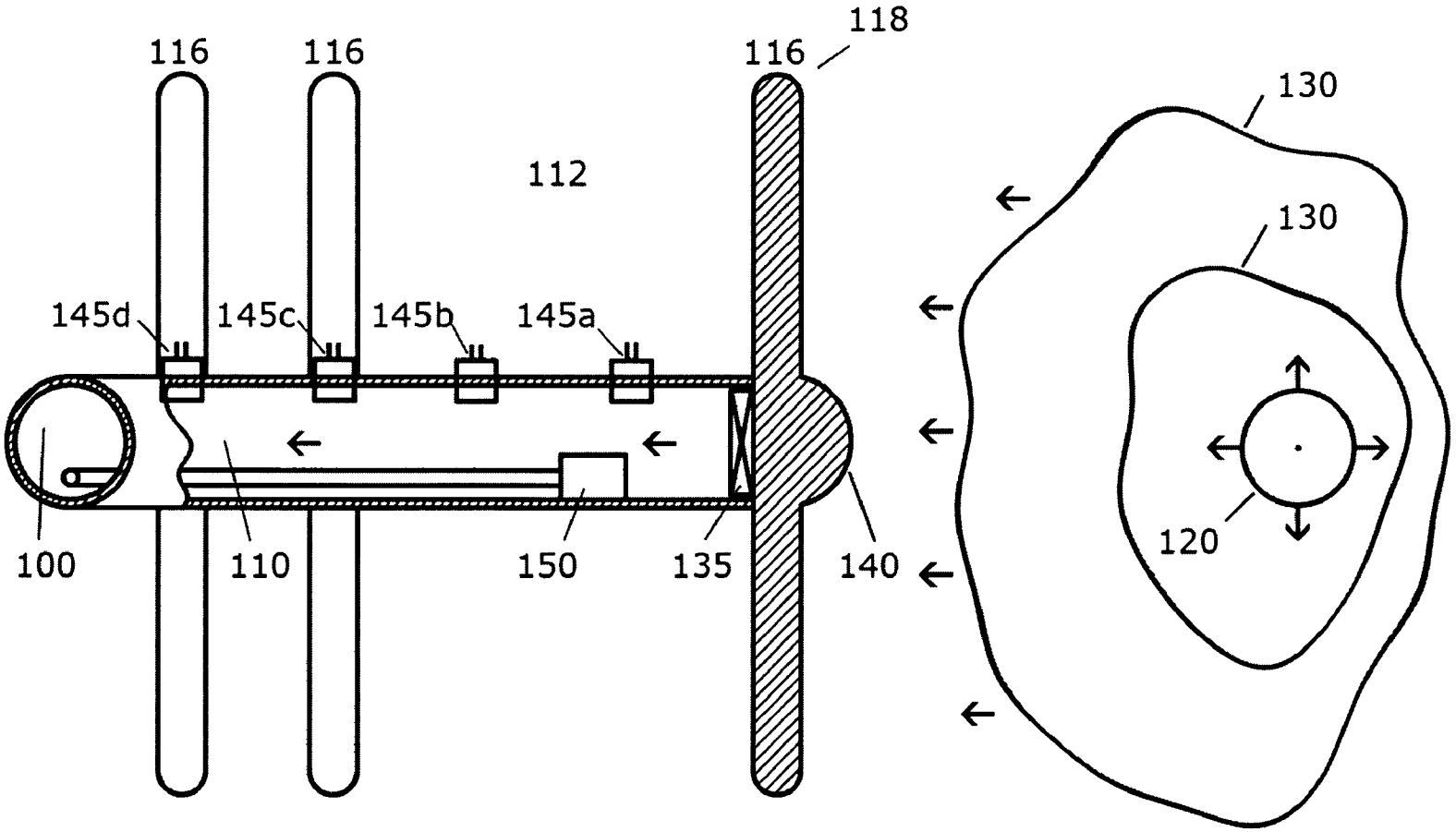
FIG. 2 is a schematic diagram illustrating one embodiment of the present invention wherein one transverse fracture in a substantially horizontal wellbore is at least partially sealed, fluid injected from a separate injection well sweeps the hydrocarbons into the remaining transverse fractures, and the inflow of fluids into the substantially horizontal wellbore is regulated with the use of inflow control devices (ICD).

The present invention is directed to a method of increasing hydrocarbon recovery from an existing well through injecting fluid to displace the hydrocarbons from the reservoir while simultaneously reducing the influx of water and other non-hydrocarbon fluids, such as carbon dioxide, into the existing well. In its most basic form, the present invention achieves its goal by providing at least one substantially horizontal wellbore, creating at least one non-conductive barrier fracture and injecting a flood fluid, such as water, into the formation so as to force the hydrocarbons into the remaining wellbore. As those of ordinary skill in the art will appreciate from the disclosure that follows, there are many different ways of arranging the substantially horizontal wells, many different ways of injecting the fluid into the formation, and many different ways of recovering the hydrocarbons into the transverse fractures. A number of exemplary ways of performing these functions are disclosed herein.

Turning to FIG. 1, a well configuration formed using a method according to U.S. Pat. No. 7,228,908 to East, Jr. et al, incorporated herein by reference, is illustrated. A substantially horizontal wellbore 110 is drilled into hydrocarbon reservoir 112 from existing well 100. Substantially horizontal wellbore 110 can be drilled using conventional directional drilling techniques or other similar methods. The wellbore 110 can be lined with a casing string 114 that may be cemented to the formation. Alternately, isolation of producing intervals may be accomplished through the use of external casing packers.

A plurality of transverse fractures 116, either conductive or non-conductive, are formed along the horizontal wellbore 110. The transverse fractures 116 are formed generally parallel to one another. There are a number of different ways of carrying out this step. In one exemplary embodiment, the plurality of transverse fractures 116 are formed by using a hydra jetting tool, such as that used in the SurgiFrac® fracturing service offered by Halliburton Energy Services. In this embodiment, the tool forms each fracture of the plurality of transverse fractures 116 one at a time. Each transverse fracture 116 can be formed by the following steps: (i) positioning the hydra jetting tool in the substantially horizontal wellbore 110 at the location where the transverse fracture 116 is to be formed, (ii) hydrajet perforating the reservoir 112 at the location where the transverse fracture 116 is to be formed, and (iii) injecting a fracture fluid into the perforation at sufficient pressure to form a transverse fracture 116 along the perforation. As those of ordinary skill in the art will appreciate, there are many variations on this embodiment. For example, fracture fluid can be simultaneously pumped down the annulus while it is being pumped out of the hydra jetting tool to initiate the fracture or not. Alternatively, the fracturing fluid may be pumped down the annulus and not through the hydra jetting tool to initiate and propagate the fracture, i.e., in this version the hydra jetting tool only forms the perforations.

In another version of this embodiment, the plurality of transverse fractures 116, either conductive or non-conductive, are formed by staged fracturing. Staged fracturing can be performed by (i) detonating a charge in the substantially horizontal wellbore 110 at the location where a transverse fracture 116 is to be formed so as to form a perforation in the reservoir at that location, (ii) pumping a fracture fluid into the perforation at sufficient pressure to propagate the transverse fracture 116, (iii) installing a plug in the substantially horizontal well 110 bore uphole of the transverse fracture 116, (iv) repeating steps (i) through (iii) until the desired number of transverse fractures 116 have been formed; and (v) removing the plugs following the completion of step (iv). As those of ordinary skill in the art will appreciate, there are many variants on the staged fracture method.

In yet another version of this embodiment, the plurality of transverse fractures 116, either conductive or non-conductive, are formed using a limited entry perforation and fracture technique. The limited entry perforation and fracture technique can be performed by (i) lining the substantially horizontal wellbore 110 with a casing string 114 having a plurality of sets of predrilled holes arranged along its length, and (ii) pumping a fracturing fluid through the plurality of sets of predrilled holes in the casing string at sufficient pressure to fracture the reservoir 112 at the locations of the sets of predrilled holes.

In still another version of this embodiment, the plurality of transverse fractures 116, either conductive or non-conductive, can be formed by the steps of (i) installing a tool having a plurality of hydra jets formed along its length into the substantially horizontal wellbore 110, and (ii) pumping fluid through the plurality of hydra jets simultaneously at one or more pressures sufficient to first perforate and then fracture the reservoir 112 at the locations of the hydra jets.

In still another version of this embodiment, the plurality of transverse fractures, either conductive or non-conductive, can be formed by the steps of (i) installing sliding sleeves as part of the casing along the length of the substantially horizontal wellbore, (ii) opening individual sleeves, and (iii) pumping fluid through the sleeves to fracture the reservoir at the location of the sleeves. The plurality of sliding sleeves can be used for fracturing purposes or be equipped with an inflow control device (ICD) for production purposes. In the case where a sleeve is used to place a non-conductive barrier fracture the sleeve is closed after placement of the fracture treatment. When all transverse fractures have been created and the associated sleeves closed, the production sleeves with ICD's are then opened to allow production. Alternately a sliding sleeve having multiple ports can be used. A multi-port sliding sleeve can utilize one port for the creation of substantially transverse fractures, which can be closed after the fracture operation is completed. A second port can then be opened which allows production through an ICD. After production through the ICD reaches unacceptable level of non-hydrocarbon fluids, the second port can then be closed. One non-limiting example of a sliding sleeve that can be used to create transverse fractures within a reservoir is the Delta Stim® sleeve and completion service offered by Halliburton Energy Services. This sliding sleeve can be shifted by either a mechanical shifting tool or alternately through a ball-drop system. The ball-drop system enables multiple sleeves to be run in a casing string with the choice of which sleeve to be shifted determined by the size of the dropped ball.

After the substantially horizontal wellbore 110 has been cased one or more non-conductive and/or conductive transverse fractures 116 can be created. The non-conductive transverse fracture can be referred to as a non-conductive Barrier Fracture (NCBF).

The casing can be cemented within the substantially horizontal wellbore 110 to isolate intervals of the reservoir or optionally the isolation of intervals along the openhole horizontal well can involve the use of external packers. One non-limiting example of an external packer that can be used to create a seal between the casing and the reservoir is the Swellpacker® isolation system offered by Halliburton Energy Services. This system operates on the swelling properties of rubber in hydrocarbons and can seal the annulus around the casing to the wellbore.

The NCBF can be placed as a remedial treatment after the well has been producing for some time. This can be accomplished by first isolating the perforations using a packer 135 (such as a hydraulically set drillable, retrievable or inflatable packer) on the end of tubing and set in the casing; then pumping the sealant in a fluid state through the tubing, then through the perforations creating a transverse fracture 118 until a sufficient volume of sealant has been placed to accomplish a barrier to flow of fluids by the flood front 130.

The sealant can be any material that can be used to create the desired transverse fracture that can form a sufficient barrier to the flow of fluids within the reservoir under the influence of the flood front 130. Non-limiting examples of a suitable sealant include a cement, a linear polymer mixture, a linear polymer mixture with cross-linker, an in-situ polymerized monomer mixture, a resin-based fluid, an epoxy based fluid, or a magnesium based slurry. Each of these sealants can be capable of being placed in a fluid state with the property of becoming a viscous fluid or solid barrier to fluid migration after or during placement into the fracture. In one embodiment, the sealant is $H_2$Zero™. Other sealants could include particles, drilling mud, cuttings, and slag. Exemplary particles could be ground cuttings so that a wide range of particle sizes would exist producing low permeability as compared to the surrounding reservoir.

An injection well 120 can be located remote from, but generally parallel to, existing well 100. In embodiment the injection well 120 can be located proximate the NCBF 118. Once the injection well 120 has been formed and the NCBF 118 is created, flood fluid can be pumped down the injection well 120. As the flood fluid is pumped into the reservoir 112 it forms a propagating flood front 130. The flood front 130 is diverted around the NCBF 118, as indicated by the large arrows. At the same time, hydrocarbons are drained into the transverse fractures 116, as indicated in by the small arrows. As the adjacent transverse fractures 116 begin producing high rates of flood fluid, they can be isolated from the production stream in the casing, such as by setting a bridge plug 135 in the substantially horizontal wellbore 110 just uphole of the particular transverse fracture that is to be isolated. The bridge plug 135 may be a mechanical bridge plug that is either drillable or retrievable. Alternatively, a plug made of a diverting agent or a removable viscous fluid. This isolation process is repeated as sufficiently high flood fluid ratios are being produced from successive production intervals until all of the production intervals have been isolated.

A device 150 for monitoring the amount of infiltration of the flood fluid into the hydrocarbons being produced in the substantially horizontal wellbore 110 is installed adjacent to one or more of the production intervals. Examples of such devices include, but are not limited to, fluid flow meters, electric resistivity devices, oxygen decay monitoring devices, fluid density monitoring devices, pressure gauge devices, and temperature monitoring devices. Data from these devices can be obtained through electric lines, fiber-optic cables, retrieval of bottom hole sensors or other methods common in the industry. Another solution involves installing a sampling line into the production flow path. This could be a tubing (coiled or jointed) that takes a sample of the fluid at a point in the wellbore. If the sampling line is continuous tubing, then the well can be continuously monitored. In yet another embodiment, a sampling chamber is formed in the production flow path so that discrete samples of fluid can be taken. With such devices/solutions, the percentage of injection fluid to hydrocarbons can be measured at the surface, so that a judgment can be made whether to close a production interval.

Turning to FIG. 2, a well configuration formed using a method according to the present invention, is illustrated. A substantially horizontal wellbore 110 is drilled into hydrocarbon reservoir 112 from existing well 100. At least one non-conductive transverse fracture(s) 116, are formed along the horizontal wellbore 110. The transverse fractures 116 are formed generally parallel to one another. The transverse fracture 116 farthest from the existing well 100 can be sealed or can be created by pumping a sealant into the reservoir while forming the transverse fracture, forming a NCBF 118. The transverse fractures 116 can be formed after the substantially horizontal wellbore 110 has been cased, such as after the casing has been cemented or alternately after the casing has been set using external packers. After casing has been cemented, productive intervals can be perforated and isolated, such as with packers and bridge plugs within the casing, to enable the forming of a transverse fracture. After casing has been set utilizing external packers, the casing can be perforated, or alternately a sliding sleeve opened, that can isolate productive intervals within the reservoir to enable the forming of a transverse fracture.

An injection well 120 can be located remote from, but generally parallel to, existing well 100. In an embodiment the injection well 120 can be located proximate the sealed NCBF 118. Once the injection well 120 has been formed and the transverse fracture 118 is created or sealed to form a NCBF 118, flood fluid can be pumped down the injection well 120. As the flood fluid is pumped into the reservoir 112 it forms a propagating flood front 130. The flood front 130 is diverted around the NCBF 118, as indicated by the large arrows. At the same time, hydrocarbons are drained into the wellbore 110 or transverse fractures 116, as indicated by the small arrows. The production into the horizontal wellbore 110 is restricted by use of one or more inflow control device (ICD) 145. The ICD 145 limits the production through each production interval thereby enabling a more uniform drainage from the hydrocarbon reservoir 112. For example the ICD 145*a* farthest from the existing well 100 can restrict production from the reservoir 112 farthest from the existing well 100, which can postpone the eventual breakthrough and production of the flood fluid and enable an increased ultimate hydrocarbon production from the reservoir 112.

Figure 26:
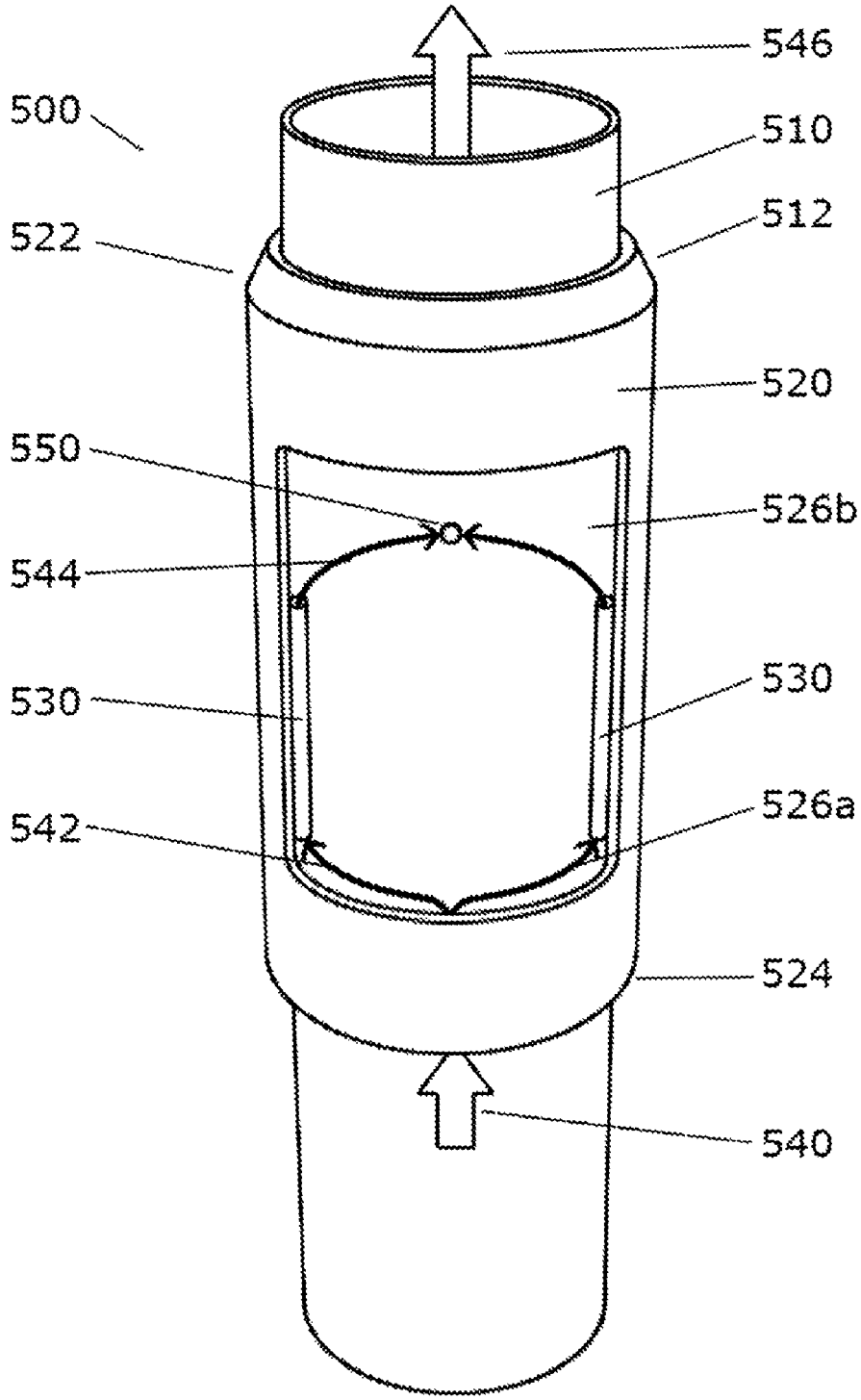
FIG. 26 is a schematic diagram illustrating an embodiment of an inflow control device (ICD) that can be used with the present invention.

An illustration of one type of ICD is shown in the cut-away view presented by FIG. 26. The ICD 500 has an inner tubular portion 510 and an outer tubular portion 520. One end 522 of the outer tubular portion 520 is sealed to the inner tubular portion 510. Another end 524 of the outer tubular portion 520 is not sealed to the inner tubular portion 510, forming an annular area between the inner tubular portion 510 and an outer tubular portion 520. One or more flow restriction tubes 530 are located in the annular area between the inner tubular portion 510 and the outer tubular portion 520. The annular area is sealed around the one or more flow restriction tubes 530 forming a first annular area 526*a* and second annular area 526*b*. Produced fluids can enter the first annular area 526*a* as shown by the arrow 540 and then enter the one or more flow restriction tubes 530 as shown by arrow 542. The flow restriction tubes 530 can limit the amount of fluids passing through them and entering the second annular area 526*b*. The produced fluids in the second annular area 526*b* can flow as indicated by arrow 544 and enter a passageway 550 that enables fluid from the second annular area 526*b* into the inner tubular portion 510. Once inside the inner tubular portion 510 the fluids 546 can be produced. The ICD can include further components not shown in FIG. 26, such as screens to filter out debris from the fluids 540 entering the ICD 500.

In an alternate embodiment of the present invention one or more of the inflow control device (ICD) 145 can be an inflow control valve (ICV). The ICV can be of any suitable design that can be closed through an intervention, such as by wireline, coiled tubing, hydraulic activation or the like. For example, referring to FIG. 2, the ICD 145*a* and ICD 145*b* can each be an ICV rather than a flow restriction ICD. When the production of the flood fluid through ICD 145*a* reaches an unacceptable level, the ICV 145*a* can be closed, thereby stopping production through ICD 145*a*. In like manner when the production of the flood fluid through ICD 145*b* reaches an unacceptable level, the ICV 145*b* can be closed, thereby stopping production through ICD 145*b*.

In an embodiment of the present invention one or more of the inflow control device (ICD) 145 can include both an inflow control device and an inflow control valve (ICV). For example, referring to FIG. 2, the ICD 145*a* and ICD 145*b* can be a combination of an ICD with an ICV. The ICV can comprise a device such as a sliding sleeve so that the ICD restricts fluid flow while the ICV is in an open position, but the sliding sleeve ICV can be subsequently closed and prohibit the flow through the ICD/ICV and into the wellbore. The ICD can restrict production through the production interval and/or from the isolated portion of wellbore, which can postpone the eventual breakthrough and production of the flood fluid thereby increasing ultimate hydrocarbon production from the reservoir 112. When the production of the flood fluid through ICD 145*a* reaches an unacceptable level, the ICV 145*a* can be closed, thereby stopping production through isolated portion of the reservoir adjacent ICD 145*a*. In like manner when the production of the flood fluid through ICD 145*b* reaches an unacceptable level, the ICV 145*b* can be closed, thereby stopping production through ICD 145*b*.

Figure 3:
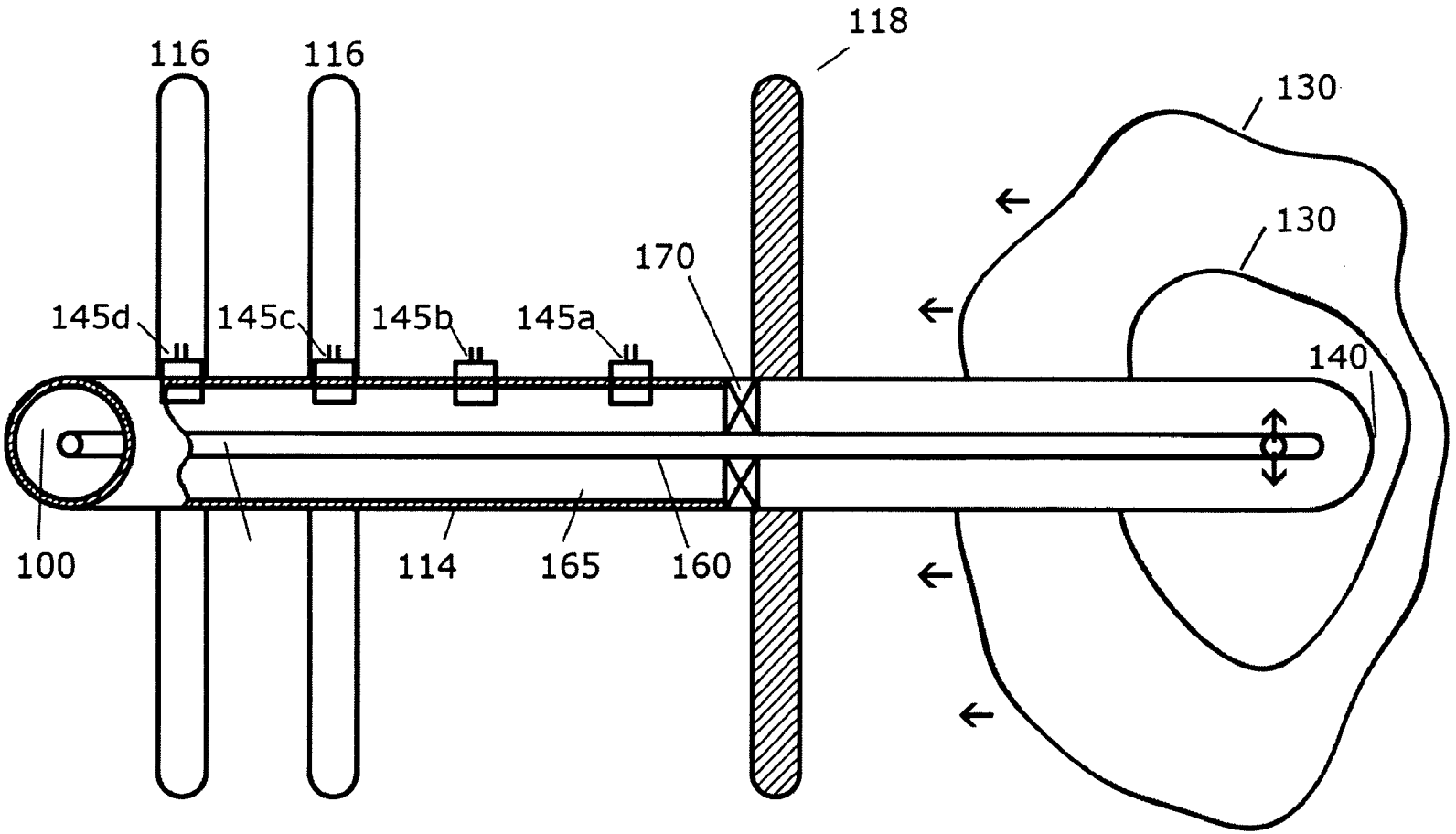
FIG. 3 is a schematic diagram illustrating another embodiment of the present invention wherein a tubing is used to inject a flood fluid into the reservoir.

Turning to FIG. 3, another embodiment of the method for increasing hydrocarbon production in accordance with the present invention is disclosed. In this embodiment, the flood fluid is introduced into the reservoir 112 through a tubing 160, which is installed into the substantially horizontal wellbore 110 rather than a separate injection well. The transverse fracture 118 nearest the toe 140 is created or sealed using any suitable technique such as those described above to form a NCBF. The tubing 160 injects the flood fluid into the reservoir 112 from the toe 140 of the substantially horizontal wellbore 110. A packer 170 seals the end of the tubing 160, so the flood fluid does not enter into the annulus 165. Hydrocarbons are produced through the transverse fractures 116, through the ICDs 145 and into the annulus 165 formed between the tubing 160 and the casing 114. As the flood front 130 moves toward the existing well 100 and the flood fluid ratio begins to increase beyond an acceptable level, the ICD having the increased flood fluid production, such as the ICD 145*a* closest to the toe 140, can be sealed, thus prohibiting the inflow of fluids through 145*a* into the annulus 165.

One or more of the inflow control device (ICD) 145 can be an inflow control device and/or an inflow control valve (ICV). The ICD 145*a* can restrict production from the portion of the wellbore adjacent ICD 145*a*. When the production of the flood fluid through ICD 145*a* reaches an unacceptable level, the ICV 145*a* can be closed, thereby stopping production from the isolated portion of the wellbore. In like manner when the production of the flood fluid through ICD 145*b* reaches an unacceptable level, the ICV 145*b* can be closed, thereby stopping production from the production interval of the wellbore.

Figure 4:
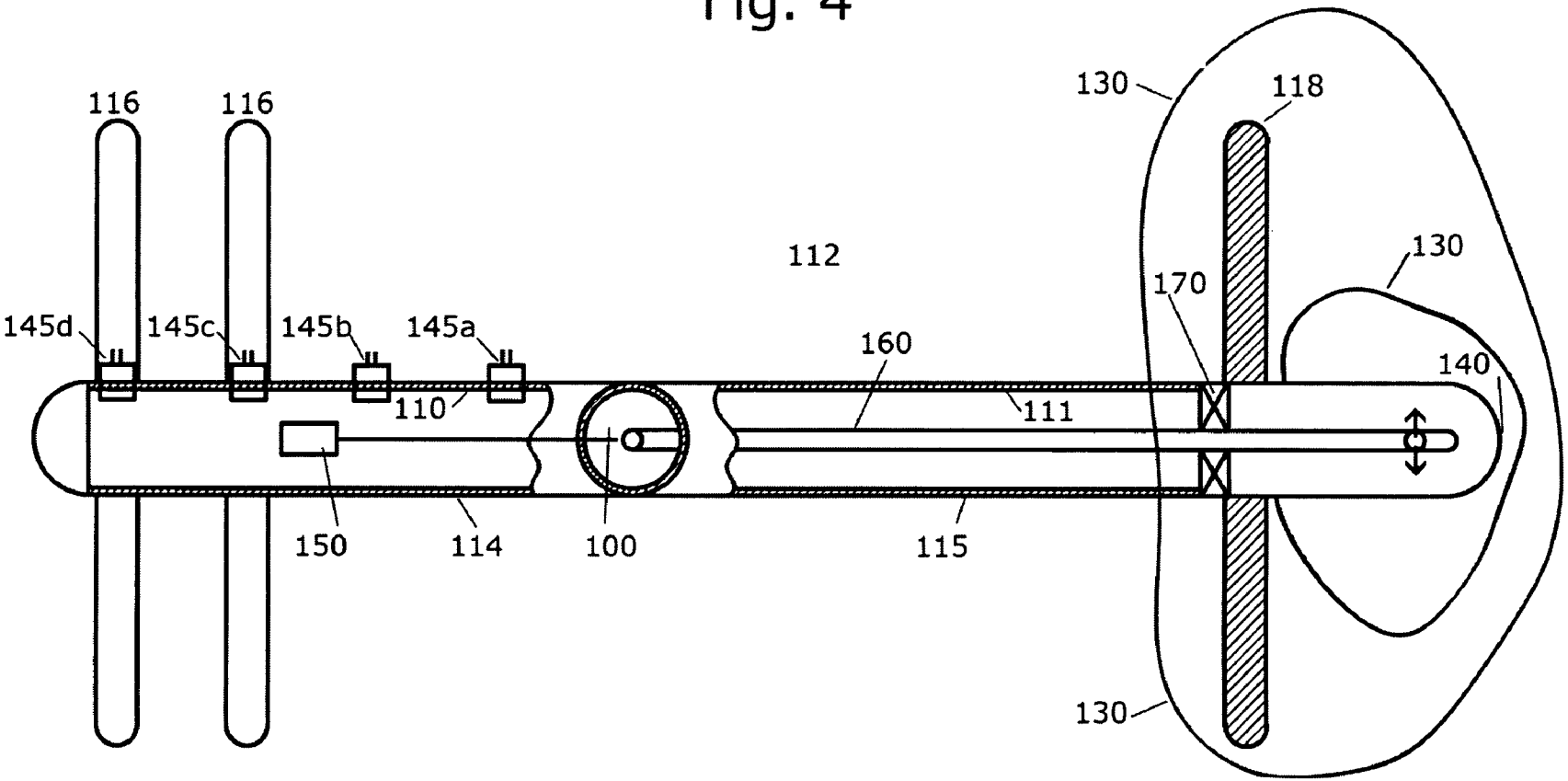
FIG. 4 is another embodiment of the present invention wherein two opposing substantially horizontal wellbores are drilled, one of which acts as an injection well, while the other of which removes the hydrocarbons through a plurality of transverse fractures having ICDs.

Turning to FIG. 4, yet another embodiment of the method in accordance with the present invention is illustrated. In this embodiment, two opposing substantially horizontal wellbores 110 and 111 are drilled into hydrocarbon reservoir 112 using conventional directional drilling techniques. Substantially horizontal wellbore 110 can be cased with casing string 114 using conventional casing techniques. Substantially horizontal wellbore 110 is also formed with a plurality of generally parallel transverse fractures 116 using any one of the techniques described above. Substantially horizontal wellbore 111 may or may not be cased with casing string 115 depending upon the condition of the reservoir. At least one NCBF 118 is formed at the toe section 140 of substantially horizontal wellbore 111. This can be accomplished by isolating the perforations adjacent to the fracture using a packer 170 on the end of the tubing 160 and setting it in the casing. Sealant can be pumped in a fluid state through the tubing 160, then through the perforations until a sufficient volume of sealant has been placed creating a fracture to form a NCBF 118 and accomplish the barrier to flow by the invading waterflood. The NCBF 118 can be formed by pumping the sealant through the perforations and fracturing the formation with the sealant, thereby creating the transverse fracture with the sealant material.

Fluid is injected into the reservoir 112 through toe section 140 of substantially horizontal wellbore 111 through the end of tubing 160. A flood front 130 propagates outward in the direction indicated by the large arrows in FIG. 4. The NCBF 118 helps to direct the fluid front in a manner that promotes drainage of the hydrocarbons into the wellbore through ICD's 145*a* and 145*b*, or through optional transverse fractures 116 and into the wellbore through ICD's 145*c* and 145*d*. The production from the reservoir 112 into the horizontal wellbore 110 is restricted by use of one or more inflow control device (ICD) 145. The ICD 145 limits the production through each adjacent area of reservoir 112 thereby enabling a more uniform drainage from the hydrocarbon reservoir 112. For example the ICD 145*a* farthest from the existing well 100 can restrict production from the area of the reservoir 112 farthest from the existing well 100, which can postpone the eventual breakthrough and production of the flood fluid through ICD 145*a* and enable an increased ultimate hydrocarbon production from the reservoir 112.

As the flood fluid ratio reaches an unacceptably high level from an isolated portion of the wellbore, the associated ICD can be sealed or closed starting with ICD 145*a* closest to existing well 100 and moving toward ICD 145*d* closest to the toe portion of substantially horizontal wellbore 110.

One or more of the inflow control device (ICD) 145 can be an inflow control device and/or an inflow control valve (ICV). The ICD 145*a* can restrict production through an adjacent transverse fracture or isolated portion of the wellbore nearest to ICD 145*a*. When the production of the flood fluid through ICD 145*a* reaches an unacceptable level, the ICV 145*a* can be closed, thereby stopping production through ICD 145*a* and the portion of the wellbore drained by ICD 145*a*. In like manner when the production of the flood fluid through ICD 145*b* reaches an unacceptable level, the ICV 145*b* can be closed, thereby stopping production through ICD 145*b* and the portion of the wellbore drained by ICD 145*b*.

A device for monitoring the amount of non-hydrocarbon fluid in the hydrocarbon production 150 may also be employed in substantially horizontal wellbore 110. The hydrocarbon production flows in the direction of the arrow moving up the annulus and wellbore 110 into existing wellbore 100.

EXAMPLES

Reservoir Simulation

Single Horizontal Well with Vertical Well Injector

Figure 5:
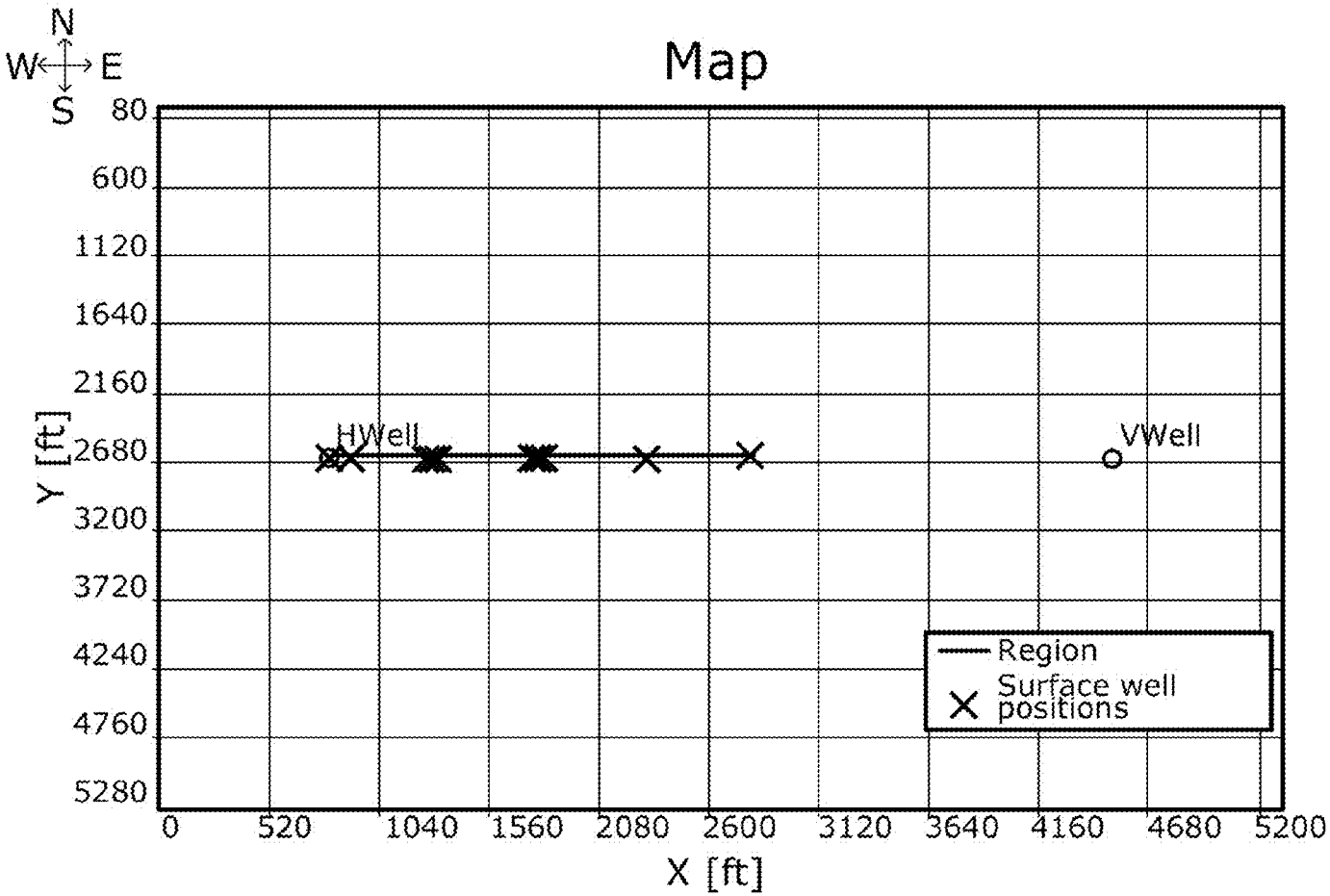
FIG. 5 is a map of a single horizontal producer with a single vertical injector that illustrates the spacing used in simulation Scenarios 1-6.

To study the effects of the aspects of the present invention a relatively simple, homogeneous reservoir was modeled for a pressure maintenance scenario in a water flood project using numerical simulation. Table 1 shows the reservoir properties modeled for Scenarios 1-6. The reservoir simulator chosen is capable of incorporating reservoir heterogeneity such as high permeability streaks, faults, dipping reservoirs, etc., and fluid properties that include high mobility ratios such as those presented by heavy oil reservoirs. FIG. 5 illustrates the well layout in map form, the map size is 1 mile by 1 mile and the boundary conditions were set as no-flow boundaries.

TABLE 1

Reservoir Properties Modeled - Scenarios 1 through 6

| Properties | |
|---|---|
| Reservoir Fluid | Black Oil |
| Water | Mobile |
| Oil API gravity | 40 |
| Gas-Oil Ratio | 700 scf/bbl |
| Water s.g. | 1.0 |
| Gas s.g. (air = 1.0) | 0.7 |
| Irreducible Water Sat. | 0.2 |
| Residual Oil Sat. | 0.1 |
| Vertical Well TVD | 8080 |
| Injector Openhole Depth | 8000-8080 ft |
| Injection Period | 10 years |
| Depth to top | 8000 ft |
| Depth to bottom | 8080 ft |
| Rock Compressibility | 3.0E−06 $psi^{-1}$ |
| Initial Res. Pressure | 3840 psi |
| Bubble Point | 3300 psi |
| No Flow Boundary | West, Top, Bottom |
| Constant Pressure | North, East, South |
| Reservoir Size | 1 mile × 1 mile |
| Horizontal Well TVD | 8017 ft |
| Producer Lateral Length | 2000 ft |
| Production Period | 10 years |

The completion scenarios chosen for comparison are described in Table 2. The flow periods and injection periods are for 10 years. A baseline scenario, referred to as Scenario 1, was modeled with an openhole horizontal producer wellbore with no non-conductive Barrier Fracture (NCBF) and no inflow control. A producer having the addition of ICD's was simulated using limited perforated intervals to produce a restriction on the fluid flow as an ICD would give, referred to as Scenario 2. In Scenario 3 a producer having both ICD's and ICV's used the same perforation configuration as Scenario 2 but were simulated as closed perforations after excessive water production occurred at each interval. A producer with one NCBF (Scenario 4) and with 5 NCBF (Scenario 5) were simulated as having barrier fractures of 1000 feet long by 1 feet thick, low porosity, low permeability streaks that are transverse to the horizontal wellbore and extending through the entire thickness of the productive interval. The NCBF were simulating a 500 feet fracture half-length and were placed in the producers prior to production and injection operations. Finally, the combination of ICD's, ICV's and five NCBF was simulated in Scenario 6 to illustrate the combination of these controls. The completion configuration for these controls is shown in Table 3.

TABLE 2

Waterflood Completion Simulation Scenarios

| Scenario | Producer | Controls | Injector |
|---|---|---|---|
| 1 | Horizontal | None | Vertical |
| 2 | Horizontal | ICD's | Vertical |
| 3 | Horizontal | ICD's & ICV's | Vertical |
| 4 | Horizontal | One NCBF at Toe | Vertical |
| 5 | Horizontal | ICD's and Five NCBF | Vertical |
| 6 | Horizontal | ICD's, ICV's & Five NCBF | Vertical |

TABLE 3

Completion Configurations of Waterflood Controls on Producers
Horizontal Producer and Vertical Injector

| Scenario | Perforation Configuration | Control Type | Flow Period |
|---|---|---|---|
| 1 | 0-2000 ft | None; openhole lateral | 10 years |
| 2 | 0-100 ft; 480-500 ft; 985-1000 ft; 1490-1500 ft; 1998-2000 ft | ICD's | 10 Years |
| 3a | 0-100 ft; 480-500 ft; 985-1000 ft; 1490-1500 ft; 1998-2000 ft | ICD's and ICV's | 1200 days |
| 3b | 0-100 ft; 480-500 ft; 985-1000 ft; 1490-1500 ft | ICD's and ICV's | 800 days |
| 3c | 0-100 ft; 480-500 ft; 985-1000 ft | ICD's and ICV's | 600 days |
| 3d | 0-100 ft; 480-500 ft | ICD's and ICV's | 400 days |
| 3e | 0-100 ft | ICD's and ICV's | 652.5 days |
| 4 | 0-100 ft; 400-500 ft; 900-1000 ft; 1400-1500 ft; 1900-2000 ft | One NCBF at 2040 ft | 10 years |
| 5 | 0-100 ft; 480-500 ft; 985-1000 ft; 1490-1500 ft; 1998-2000 ft | ICD's and Five NCBF at 2040 ft, 1750 ft, 1250 ft, 750 ft, and 250 ft | 10 years |
| 6a | 0-100 ft; 480-500 ft; 985-1000 ft; 1490-1500 ft; 1998-2000 ft | ICD's, ICV's and Five NCBF at 2040 ft, 1750 ft, 1250 ft, 750 ft, and 250 ft | 2600 days |
| 6b | 0-100 ft; 480-500 ft; 985-1000 ft; 1491500 ft | ICD's, ICV's and Five NCBF at 2040 ft, 1750 ft, 1250 ft, 750 ft, and 250 ft | 400 days |
| 6c | 0-100 ft; 480-500 ft; 985-1000 ft | ICD's, ICV's and Five NCBF at 2040 ft, 1750 ft, 1250 ft, 750 ft, and 250 ft | 300 days |
| 6d | 0-100 ft; 480-500 ft | ICD's, ICV's and Five NCBF at 2040 ft, 1750 ft, 1250 ft, 750 ft, and 250 ft | 200 days |

TABLE 3-continued

| Completion Configurations of Waterflood Controls on Producers Horizontal Producer and Vertical Injector | | | |
|---|---|---|---|
| Scenario | Perforation Configuration | Control Type | Flow Period |
| 6e | 0-100 ft | ICD's, ICV's and Five NCBF at 2040 ft, 1750 ft, 1250 ft, 750 ft, and 250 ft | 152.5 days |

Figure 6:
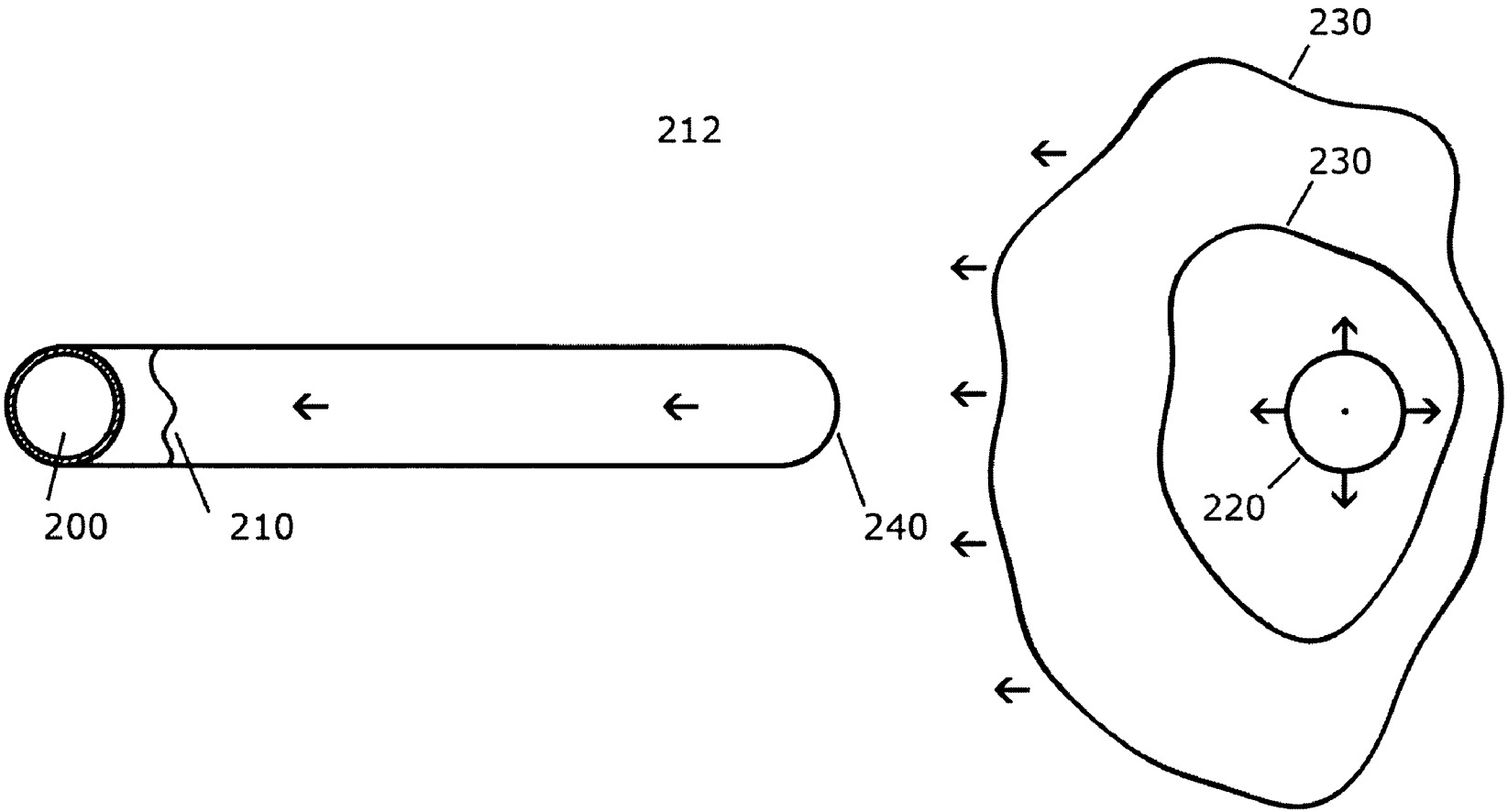
FIG. 6 is a schematic diagram illustrating an embodiment of the present invention that illustrates aspects used in simulation Scenario 1.

FIG. 6 provides a schematic diagram illustrating the embodiment of the present invention modeled in Scenario 1 that consists of an openhole horizontal producing well 210 with a vertical openhole injector well 220. The completion is a 2,000 ft openhole, horizontal lateral for production with no inflow controls. The injector was a fully penetrating openhole vertical well.

Figure 7:
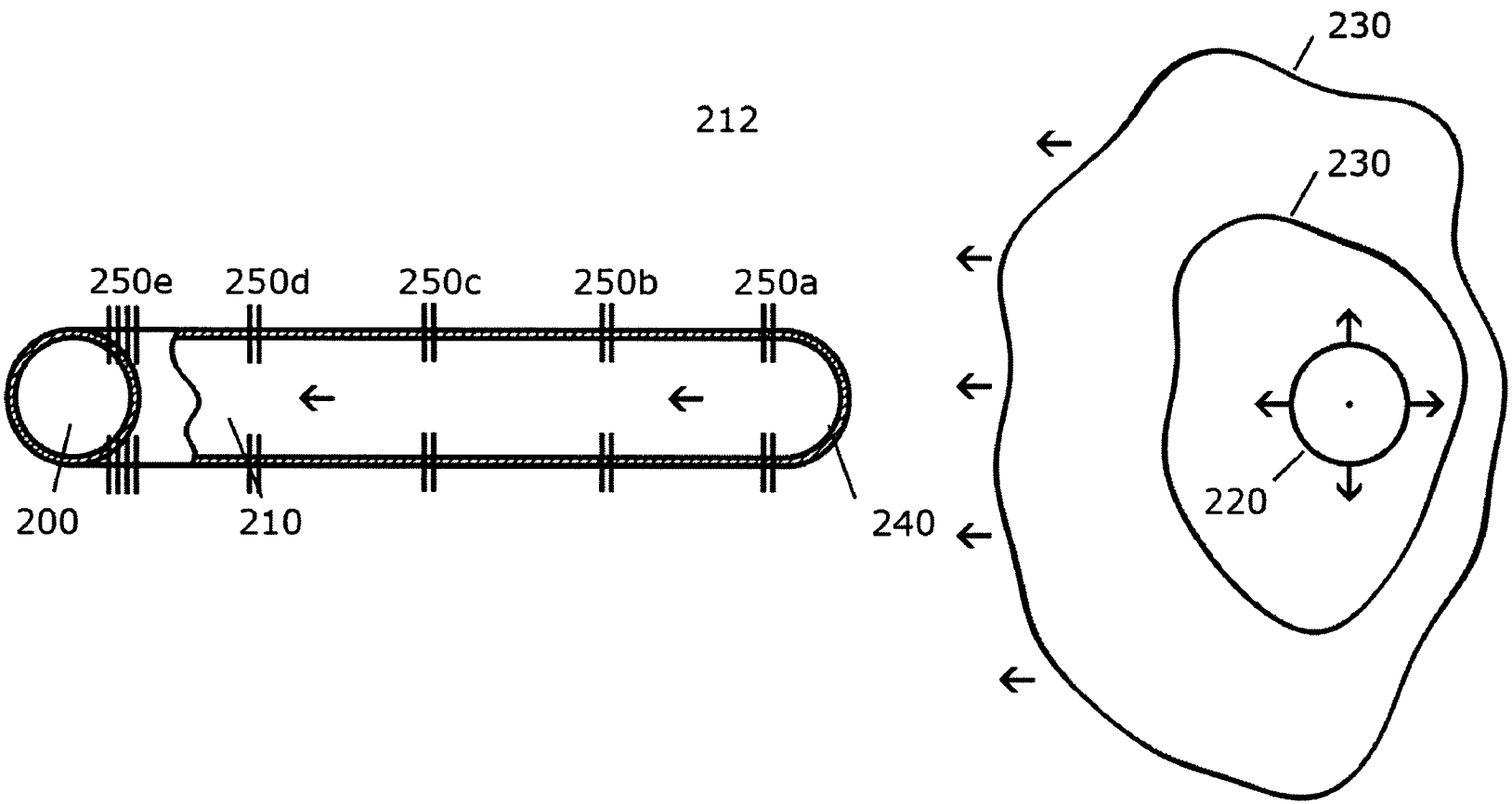
FIG. 7 is a schematic diagram illustrating an embodiment of the present invention that illustrates aspects used in simulation Scenario 2.

FIG. 7 provides a schematic diagram illustrating the embodiment of the present invention modeled in Scenario 2 that consists of the same wellbore configuration and well placement as in Scenario 1 but with a cased horizontal producing well 210 having a perforation configuration 250*a*-250*e* to simulate the use of ICD control of the produced fluids.

Figure 8:
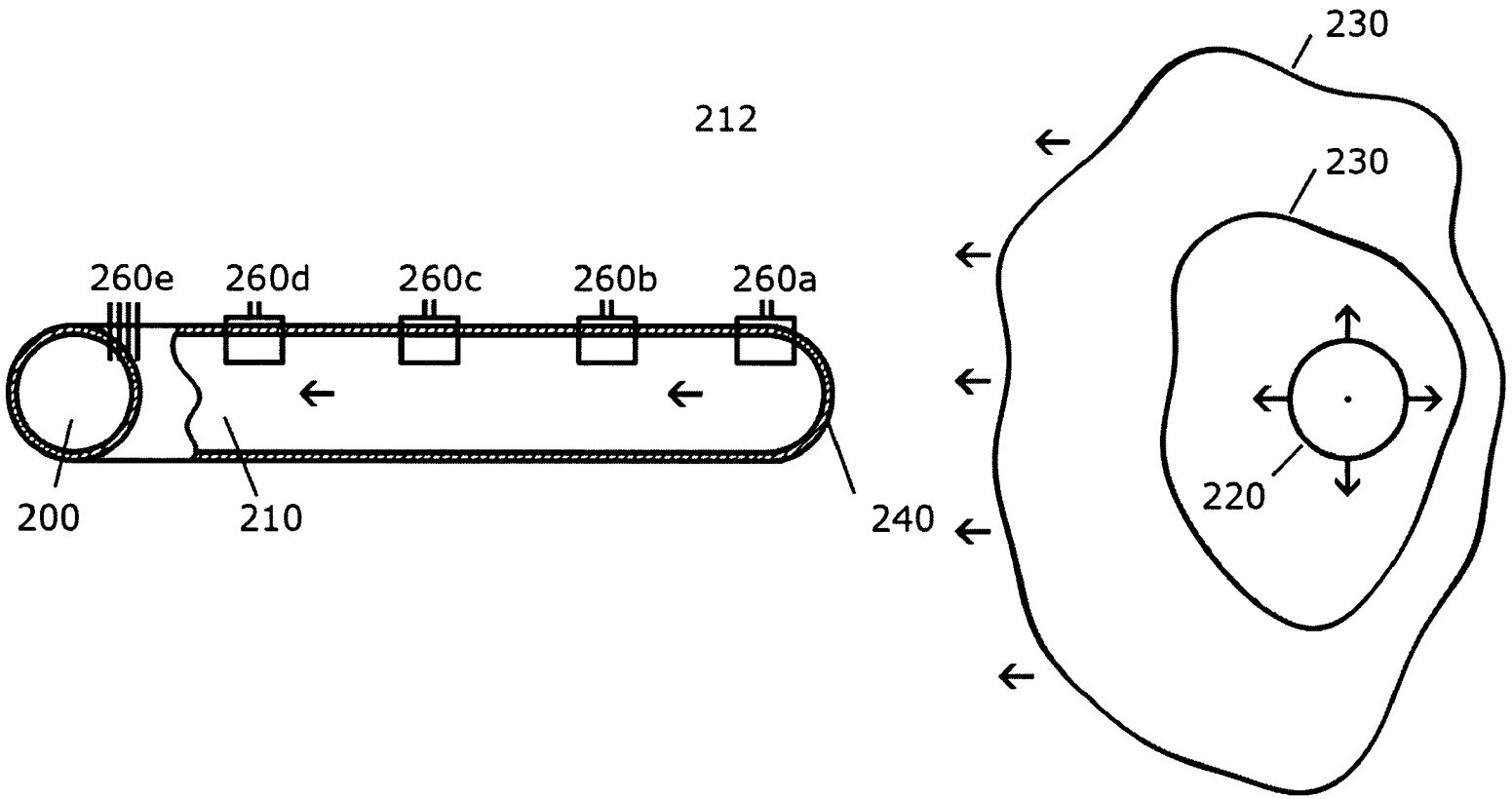
FIG. 8 is a schematic diagram illustrating an embodiment of the present invention that illustrates aspects used in simulation Scenario 3.

FIG. 8 provides a schematic diagram illustrating the embodiment of the present invention modeled in Scenario 3 that consists of the same wellbore configuration and well placement as in Scenario 2. As water breakthrough occurred in each interval the perforations were eliminated to simulate the closing of ICV's 260*a*-260*d*. The configuration for each flow period is shown in Table 3.

Figure 9:
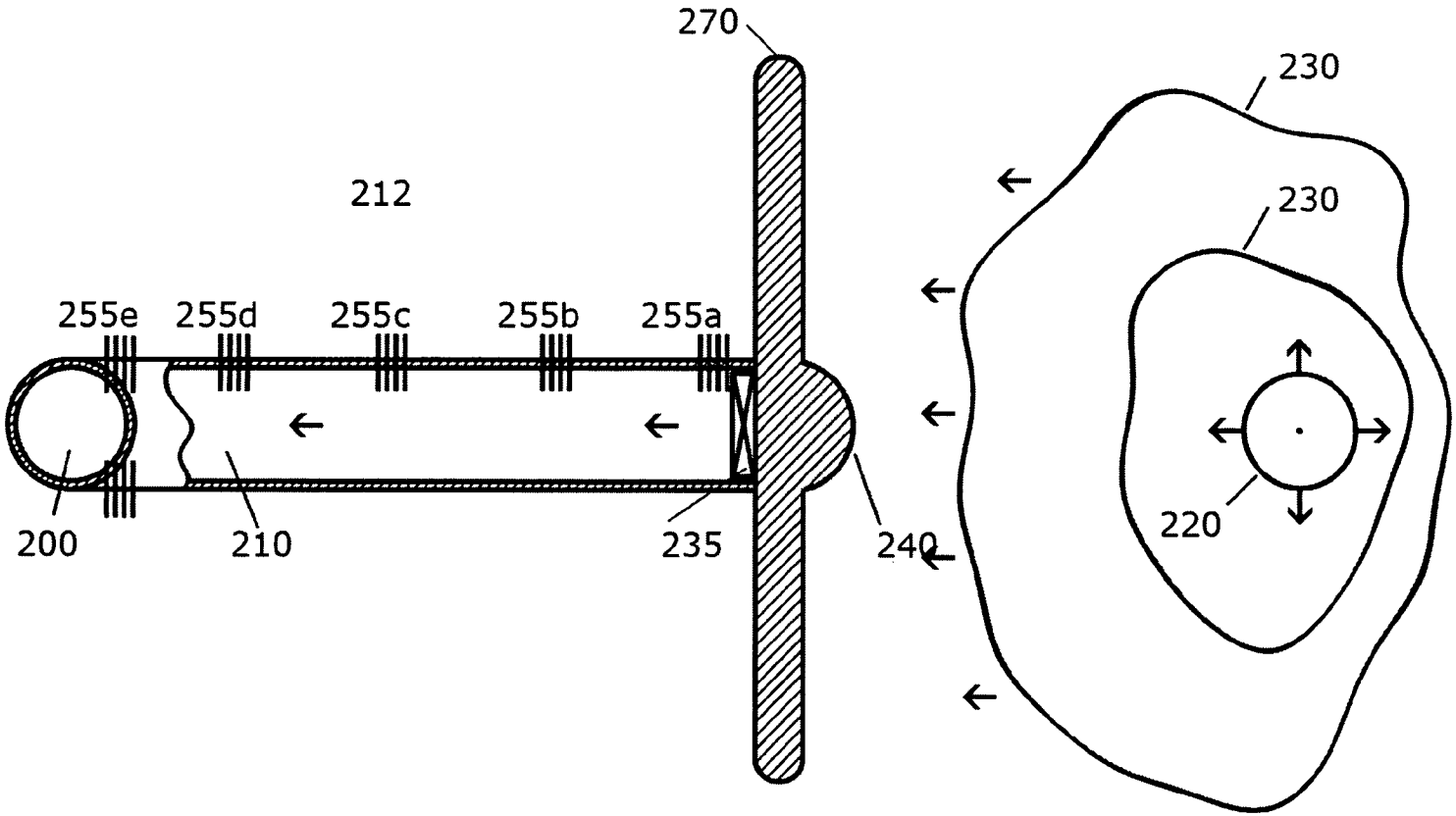
FIG. 9 is a schematic diagram illustrating an embodiment of the present invention that illustrates aspects used in simulation Scenario 4.

FIG. 9 provides a schematic diagram illustrating the embodiment of the present invention modeled in Scenario 4 that consists of the same wellbore configuration and well placement as in Scenario 2 but with a perforation configuration 255*a*-255*e* as shown in Table 3 and having a single transversally oriented NCBF 270 located at the toe 240 of the horizontal producing well. The NCBF are simulated to have a 500 feet fracture half-length.

Figure 10:
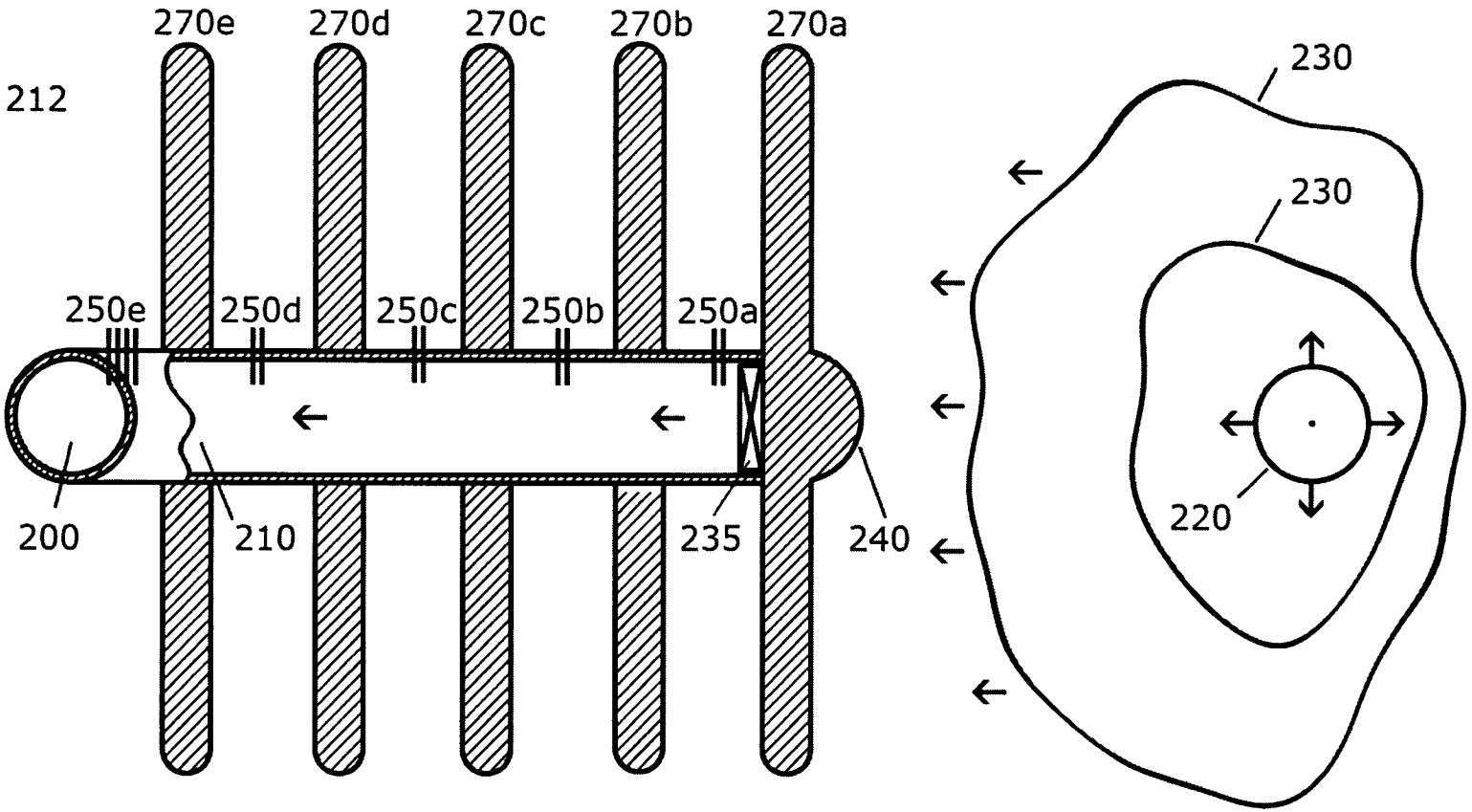
FIG. 10 is a schematic diagram illustrating an embodiment of the present invention that illustrates aspects used in simulation Scenario 5.

FIG. 10 provides a schematic diagram illustrating the embodiment of the present invention modeled in Scenario 5 that consists of the same wellbore configuration and well placement as in Scenario 4 but with perforation configurations 250*a*-250*e* to simulate ICD control of production fluids and five transversally oriented NCBF 270*a*-270*e* of 500 feet fracture half-length spaced according to the configuration in Table 3 so that between each set of perforations 250*a*-250*e* there is a corresponding NCBF 270*a*-270*e*.

Figure 11:
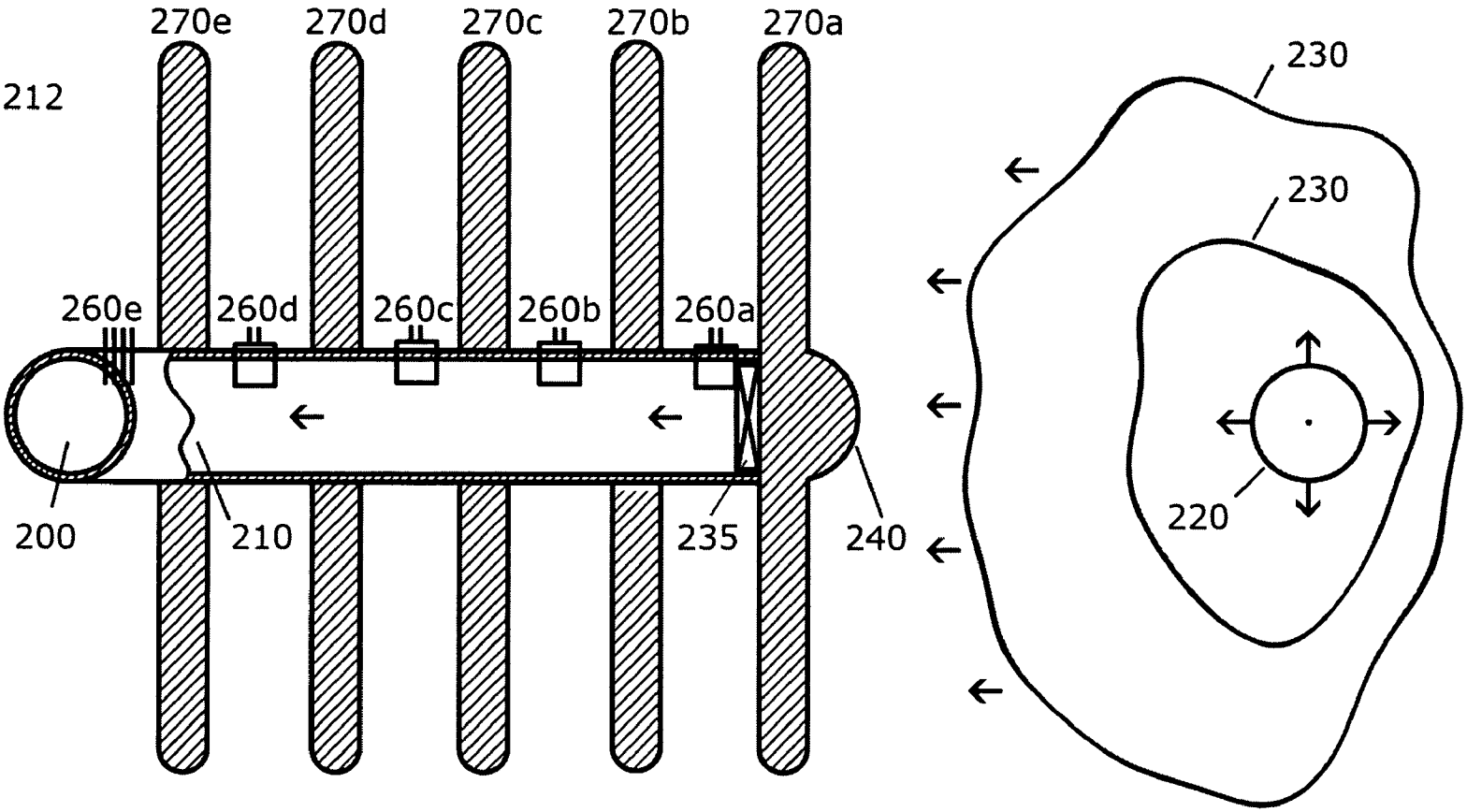
FIG. 11 is a schematic diagram illustrating an embodiment of the present invention that illustrates aspects used in simulation Scenario 6.

FIG. 11 provides a schematic diagram illustrating the embodiment of the present invention modeled in Scenario 6 that consists of the same wellbore configuration, well placement, perforation configuration and five transversally oriented NCBF 270*a*-270*e* of 500 feet fracture half-length as in Scenario 5 but with ICV 260*a*-260*d* controls at each set of perforations. As water breakthrough occurred in each interval the perforations were eliminated to simulate the closing of ICV's 260*a*-260*d*.

The production rate for each producer in scenarios 1-6 was limited to 10,000 bpd of Water+Oil maximum and the injection rate was set at 10,000 BWPD. The vertical injection well in all scenarios was simulated as an openhole completion. The vertical well was completely penetrating the production interval. The 2000 ft horizontal lateral was placed at 2015 ft vertical depth. The vertical injection well placement is shown in FIG. 5.

Results—Single Horizontal Producer with Vertical Injector—Scenarios 1-6

Figure 12:
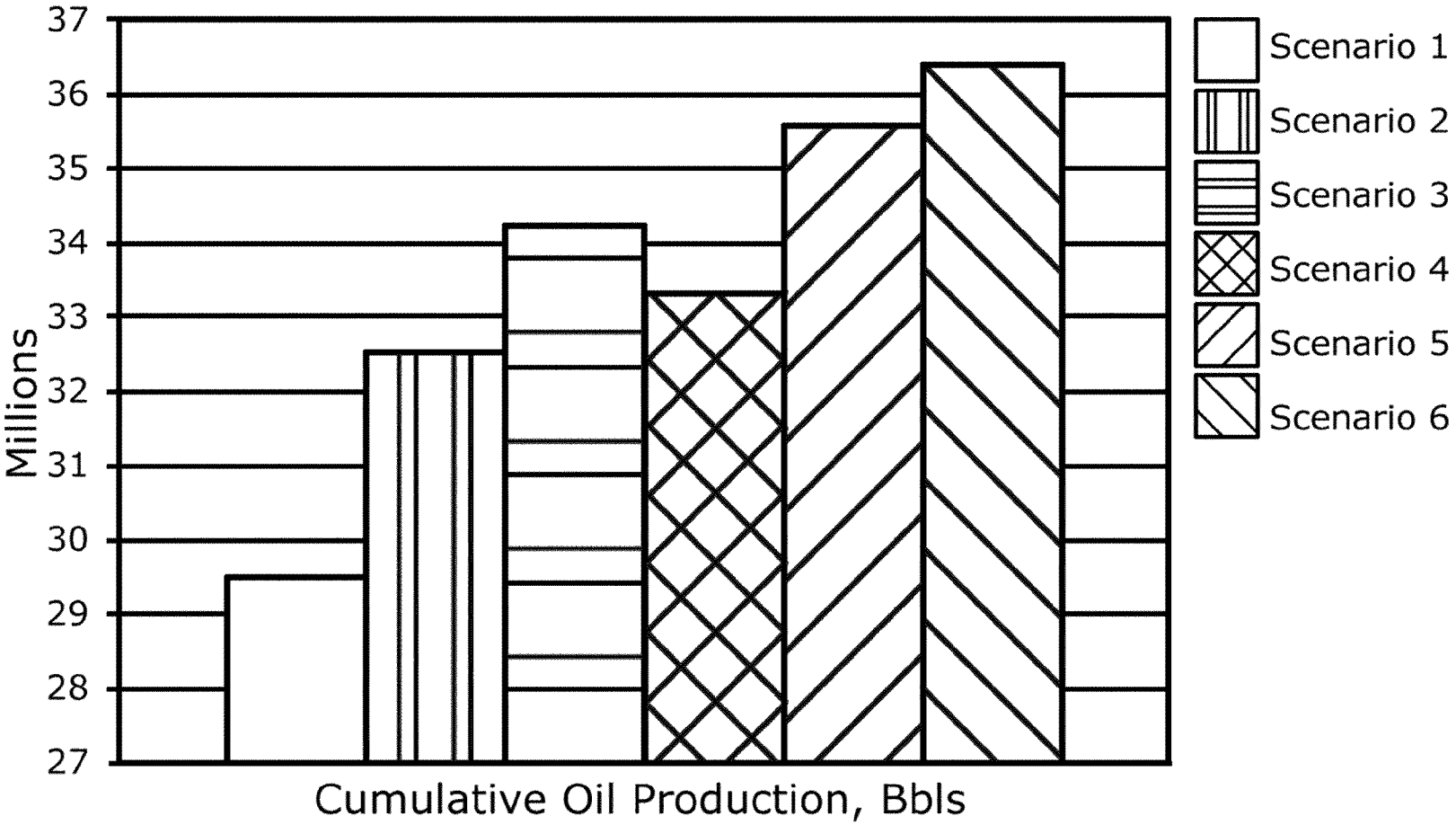
FIG. 12 is a graph of cumulative oil production of various well configuration scenarios.
Figure 13:
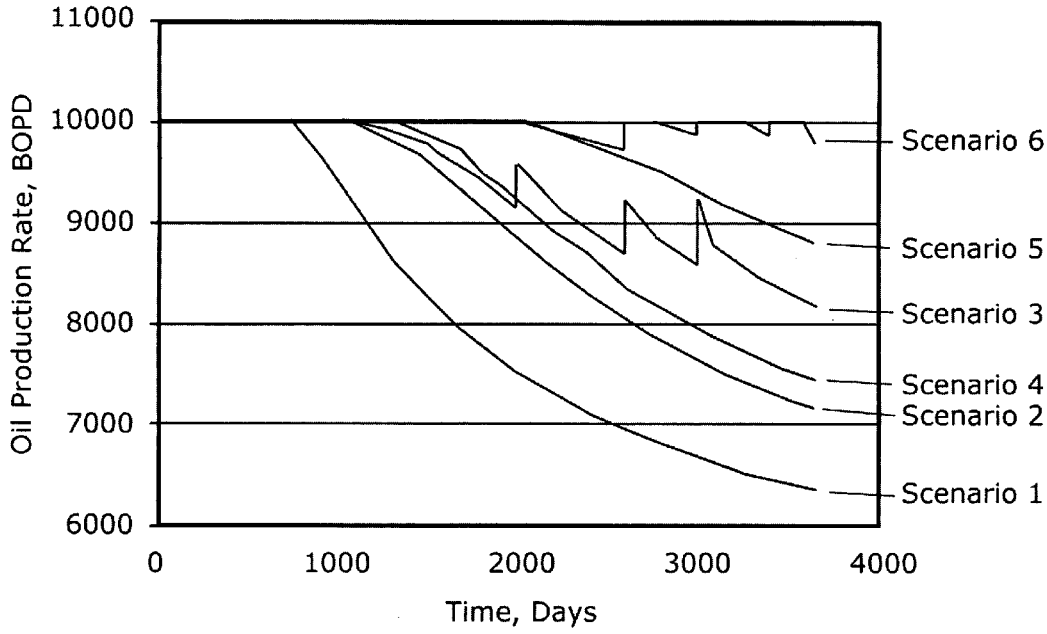
FIG. 13 is a graph of oil production rates from various well configuration scenarios.

Referring to FIG. 12, the cumulative oil production for the ten-year production period varied from 29,502,496 bbls for Scenario 1 base case with no inflow controls to 36,408,517 bbls for Scenario 6 with 5 NCBF, ICD's and ICV's controls—an improvement of 23.4% with an increment oil recovery of 6,906,020 bbls. The benefit to the daily oil production rates for Scenarios 1-6 is illustrated in FIG. 13. The effect of the use of ICV's in Scenario 3 and Scenario 6 is evident in the sudden increase in oil production as each set of perforations is closed.

Figure 14:
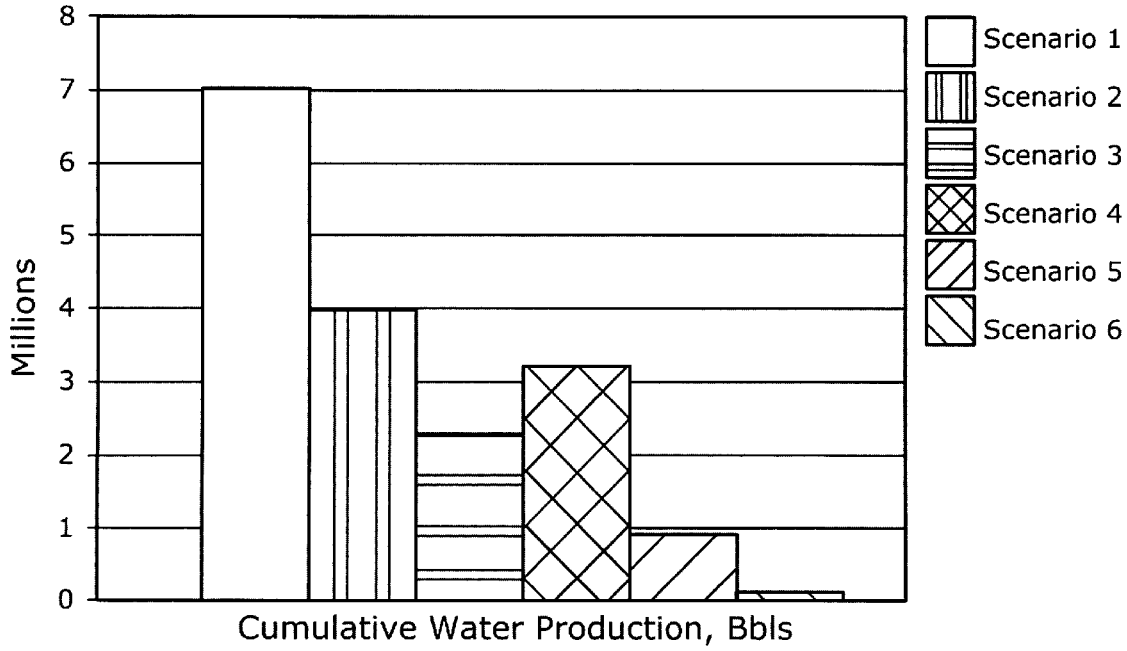
FIG. 14 is a graph of cumulative water production of various well configuration scenarios.
Figure 15:
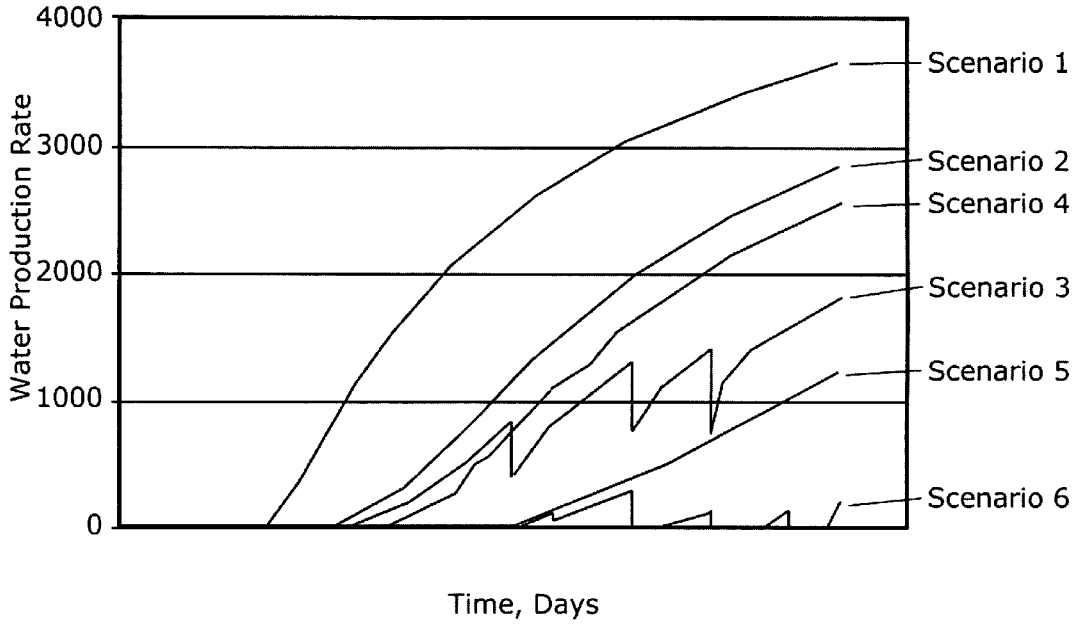
FIG. 15 is a graph of water production rates from various well configuration scenarios.

Referring to FIG. 14, the cumulative water production for the ten year production period with 10,000 bwpd water injection varied from 7,022,504 bbls for Scenario 1 base case with no inflow controls to 116,481 bbls for Scenario 6 with 5 NCBF, ICD's and ICV's controls—a reduction of 6,906,023 bbls of produced water. The timing of the floodfront water breakthrough and control of water production can be determined for each scenario in FIG. 15. The effect of the use of ICV's in Scenario 3 and Scenario 6 is evident in the sudden decrease in water production as each set of perforations is closed.

Reservoir Simulation—Dual Horizontal Wells with Horizontal Well Injector

Figure 16:
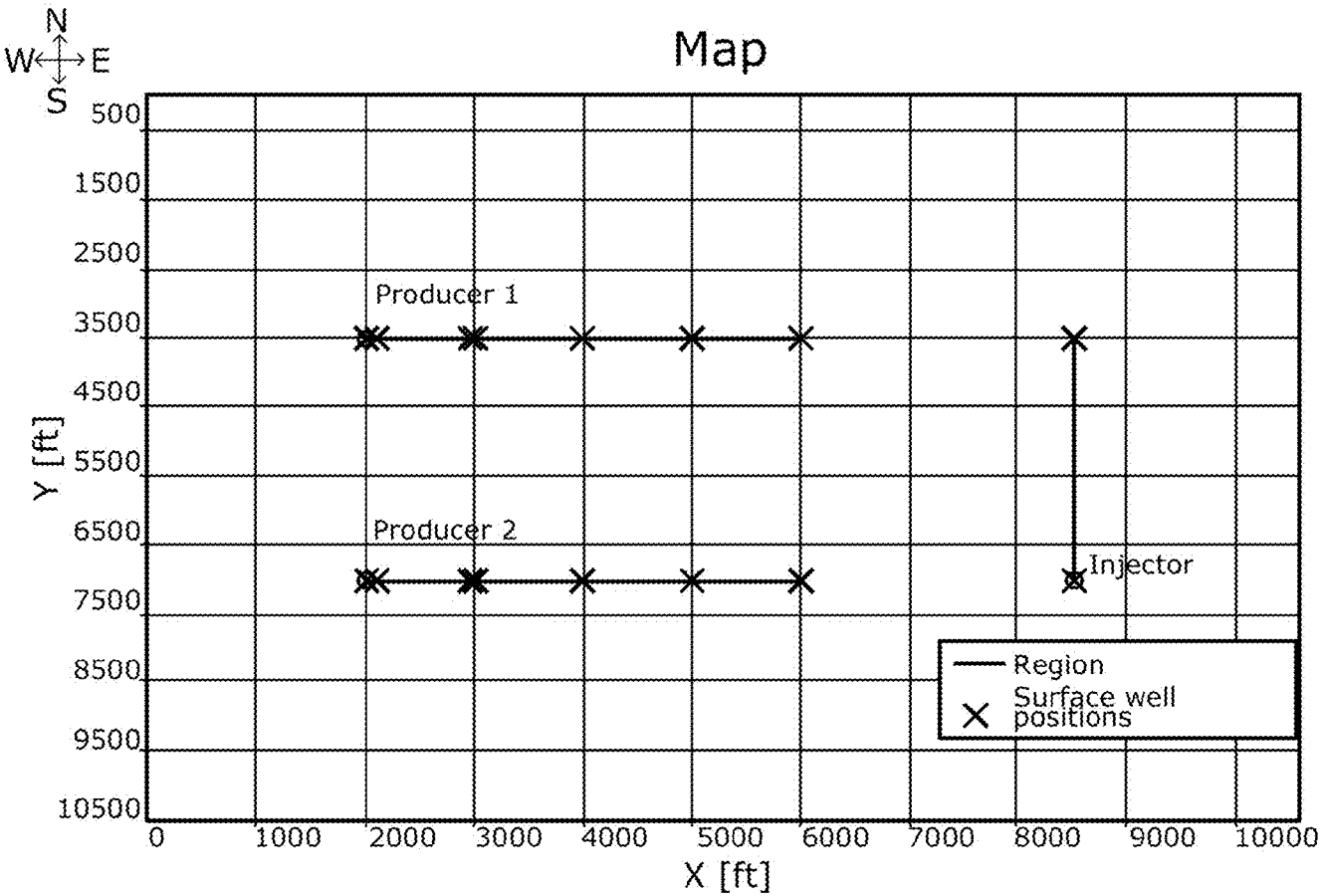
FIG. 16 is a map of a pair of horizontal producers with a single horizontal injector that illustrates the spacing used in simulation Scenarios 7-10.

A final comparison study (Scenario 7, 8, 9, 10) was performed for a pair of horizontal producers with a horizontal injector well transverse to the direction of the parallel producers, as shown in FIG. 16. The parallel producing wells were 4000 ft long and placed at 8012 ft vertical depth. The distance between the producer wells was 3520 ft. The 3520 ft horizontal injection well was placed at 8065 ft vertical depth. The production rate for each producer in Scenarios 7-10 was limited to 10,000 bpd of Water+Oil maximum and the injection rate was set at 20,000 BWPD. The flow periods for each Scenario were 5 years. Reservoir properties that were modeled are shown in Table 4. Controls in this case were similar to the previous scenarios and controls during each simulation were identical for each producer as listed in Tables 5 and 6. FIG. 16 shows the well locations in map form, the map size is 2 miles by 2 miles and the boundary conditions were set as no-flow boundaries.

TABLE 4

| Reservoir Properties Modeled - Scenarios 7 through 10 | |
|---|---|
| Properties | |
| Reservoir Fluid | Black Oil |
| Water | Mobile |
| Oil API gravity | 32 |
| Gas-Oil Ratio | 700 scf/bbl |
| Water s.g. | 1.2 |
| Gas s.g. (air = 1.0) | 0.7 |
| Irreducible Water Sat. | 0.32 |
| Residual Oil Sat. | 0.1 |
| Inector Well TVD | 8065 |
| Injector Lateral Length | 3520 ft |

TABLE 4-continued

| Reservoir Properties Modeled - Scenarios 7 through 10 | |
|---|---|
| Properties | |
| Injection Period | 5 years |
| Depth to top | 8000 ft |
| Depth to bottom | 8080 ft |
| Rock Compressibility | 3.0E–06 $psi^{-1}$ |
| Initial Res. Pressure | 3800 psi |
| Bubble Point | 2000 psi |
| No Flow Boundary | West, Top, Bottom |
| No Flow Boundary | North, East, South |
| Reservoir Size | 2 miles × 2 miles |
| Producer Well TVD | 8012 ft |
| Producer Lateral Length | 4000 ft |
| Production Period | 5 years |

TABLE 5

Waterflood Completion Simulation Scenarios

| Scenario | Producer | Controls | Injector |
|---|---|---|---|
| 7 | Dual Horizontals | none | Horizontal |
| 8 | Dual Horizontals | ICD's and one NCBF | Horizontal |
| 9 | Dual Horizontals | ICD's and five NCBF | Horizontal |
| 10 | Dual Horizontals | ICV's and five NCBF | Horizontal |

TABLE 6

Completion Configurations of Waterflood Controls on Producers
Parallel Horizontal Producers, Horizontal Injector

| Scenario | Perforation Configuration | Control Type | Flow Period |
|---|---|---|---|
| 7 | 0-4000 ft | No Controls; Open hole laterals | 5 years |
| 8 | 0-100 ft; 960-1000 ft; 1980-2000 ft; 2990-3000 ft; 3995-4000 ft | ICD's and one NCBF at 4015 ft | 5 years |
| 9 | 0-100 ft; 960-1000 ft; 1980-2000 ft; 2990-3000 ft; 3995-4000 ft | ICD's and five NCBF at 4015 ft, 3500 ft, 2500 ft, 1500 ft, and 500 ft | 5 years |
| 10a | 0-100 ft; 900-1000 ft; 1900-2000 ft; 2990-3000 ft; 3900-4000 ft | ICV's and five NCBF at 4015 ft, 3500 ft, 2500 ft, 1500 ft, and 500 ft | 900 days |
| 10b | 0-100 ft; 900-1000 ft; 1900-2000 ft; 2990-3000 ft | ICV's and five NCBF at 4015 ft, 3500 ft, 2500 ft, 1500 ft, and 500 ft | 300 days |
| 10c | 0-100 ft; 900-1000 ft; 1900-2000 ft | ICV's and five NCBF at 4015 ft, 3500 ft, 2500 ft, 1500 ft, and 500 ft | 300 days |
| 10d | 0-100 ft; 900-1000 ft | ICV's and five NCBF at 4015 ft, 3500 ft, 2500 ft, 1500 ft, and 500 ft | 200 days |
| 10e | 0-100 ft | ICV's and five NCBF at 4015 ft, 3500 ft, 2500 ft, 1500 ft, and 500 ft | 126.25 days |

Figure 17:
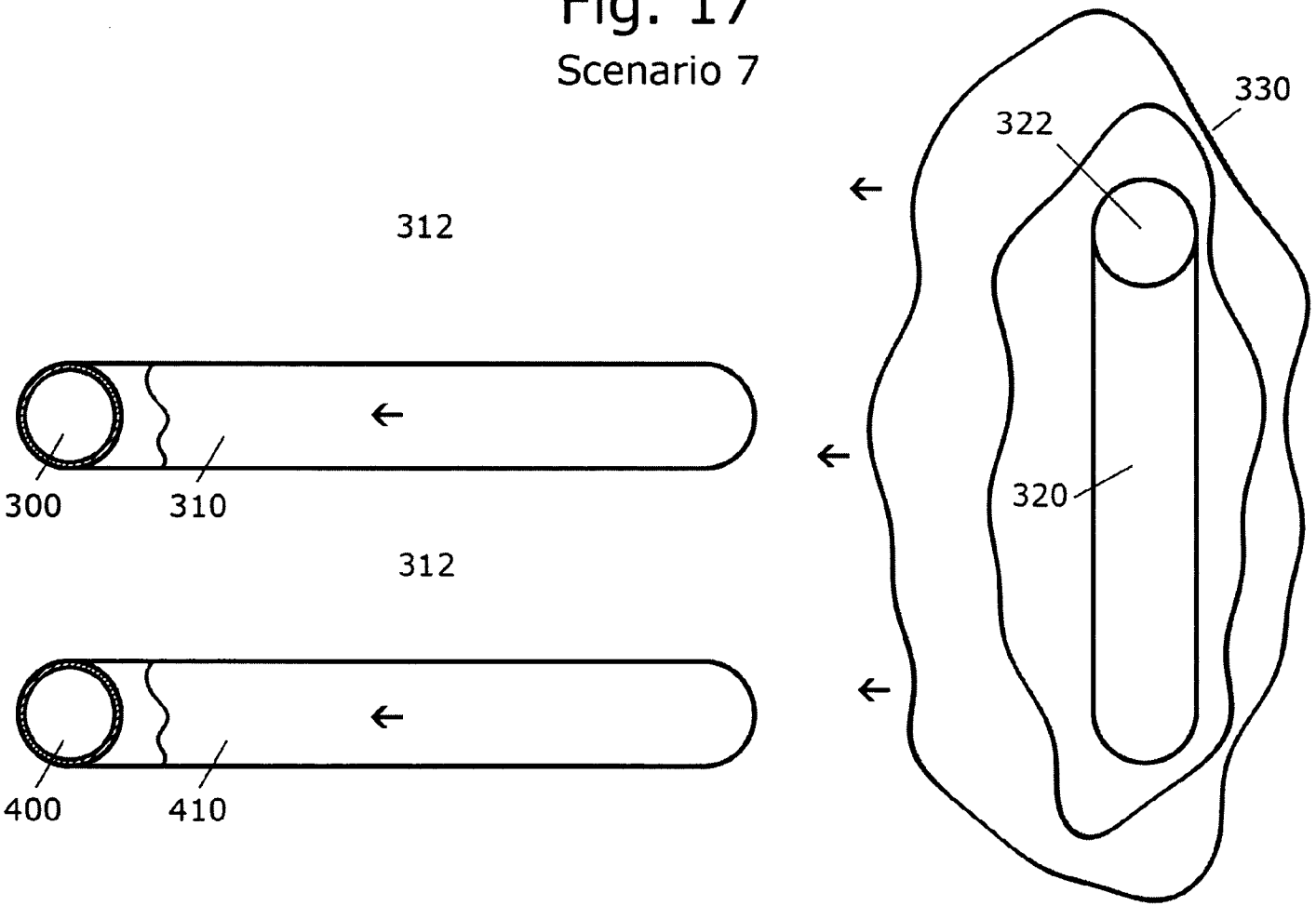
FIG. 17 is a schematic diagram illustrating an embodiment of the present invention that illustrates aspects used in simulation Scenario 7.

FIG. 17 provides a schematic diagram illustrating the embodiment of the present invention modeled in Scenario 7 that consists of two openhole horizontal producing wells 310, 410 with a single horizontal openhole injector well 320. The base case completion was a pair of parallel 4,000 ft openhole, horizontal laterals for production with no inflow controls. The injector was an openhole horizontal well transversally oriented to the producers.

Figure 18:
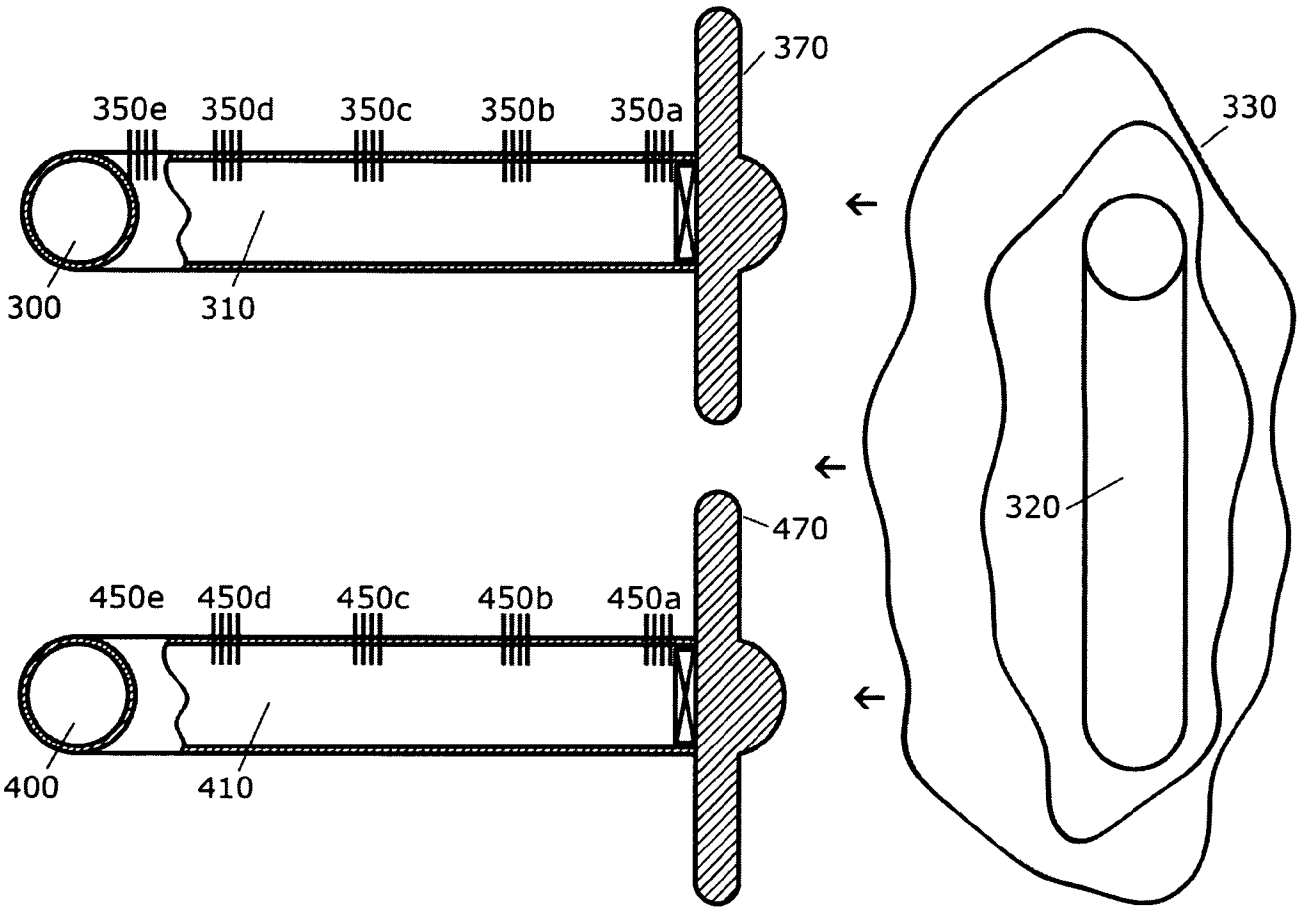
FIG. 18 is a schematic diagram illustrating an embodiment of the present invention that illustrates aspects used in simulation Scenario 8.

FIG. 18 provides a schematic diagram illustrating the embodiment of the present invention modeled in Scenario 8 that consists of the same wellbore configuration and well placement as in Scenario 7 but with each horizontal producing well 310, 410 being cased and having perforation configurations 350*a*-350*e*, 450*a*-450*e* to simulate the use of ICD control of the produced fluids. Also a single transversally oriented 500 ft half-length NCBF 370, 470 was placed at the toe of each producing well.

Figure 19:
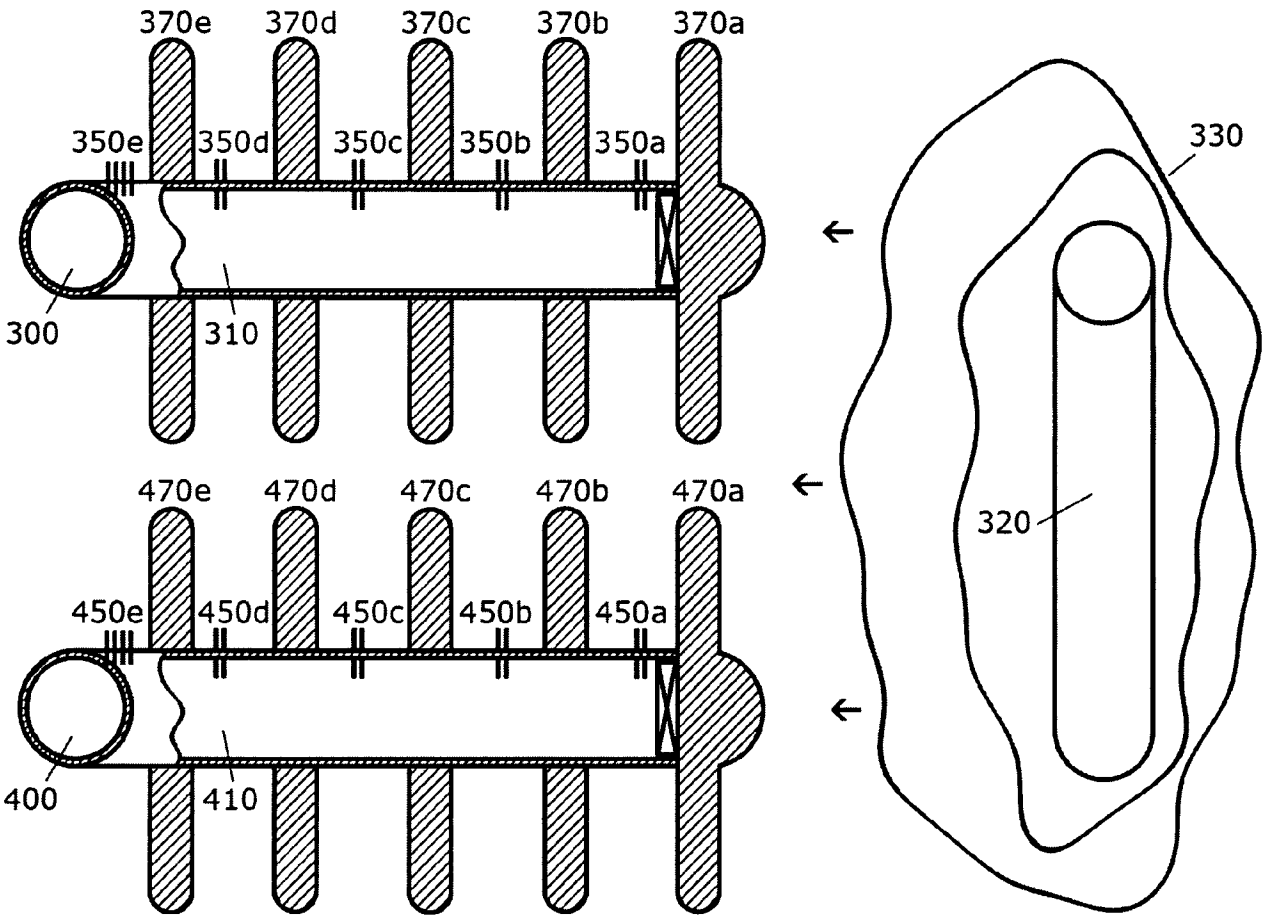
FIG. 19 is a schematic diagram illustrating an embodiment of the present invention that illustrates aspects used in simulation Scenario 9.

FIG. 19 provides a schematic diagram illustrating the embodiment of the present invention modeled in Scenario 9 consists of the same wellbore configuration, well placement and perforation configuration as in Scenario 8 but with five transversally oriented 500 ft half-length NCBF 370*a*-370*e*, 470*a*-470*e* spaced according to the configuration in Table 6.

Figure 20:
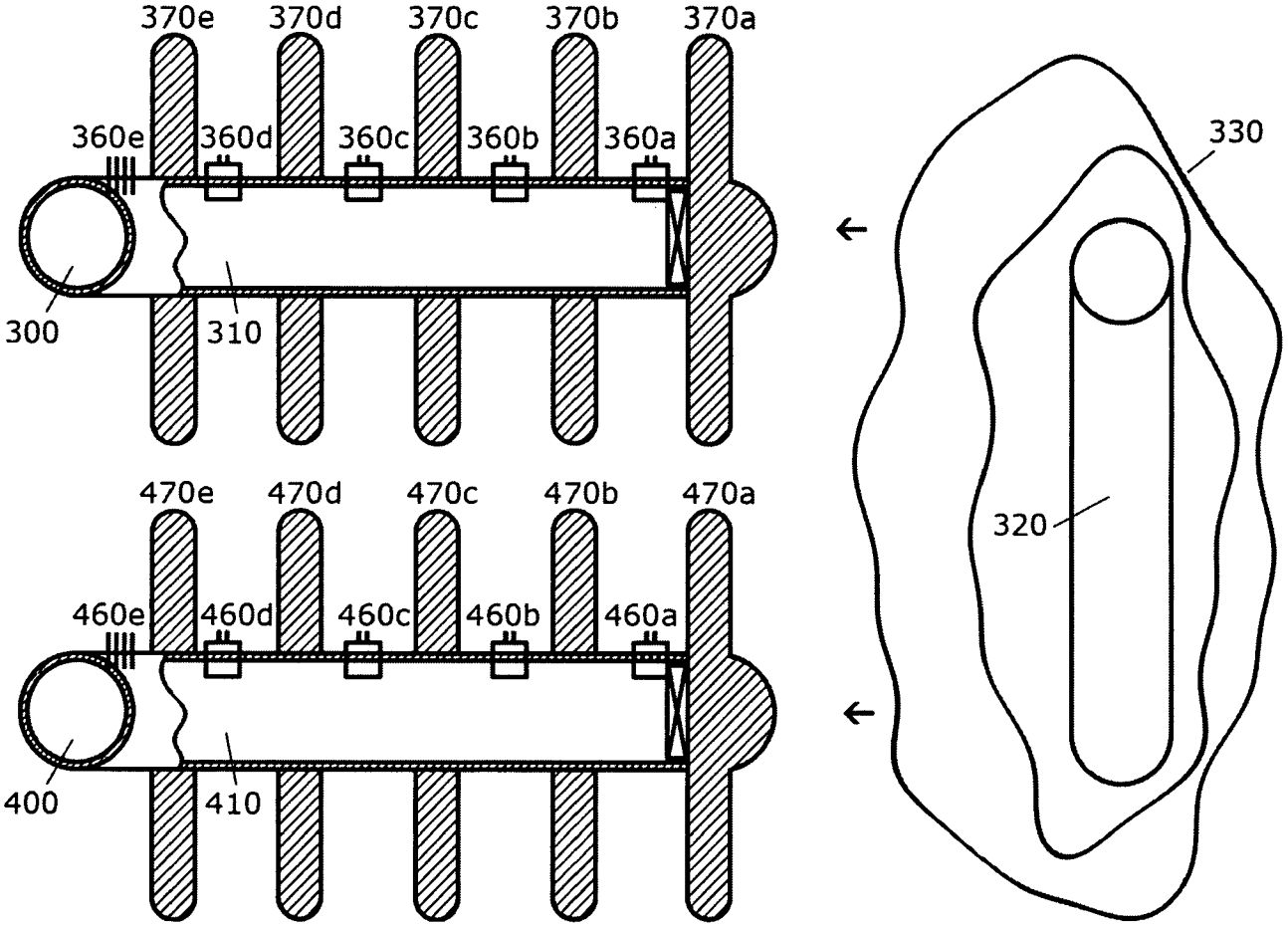
FIG. 20 is a schematic diagram illustrating an embodiment of the present invention that illustrates aspects used in simulation Scenario 10.

FIG. 20 provides a schematic diagram illustrating the embodiment of the present invention modeled in Scenario 10 consists of the same wellbore configuration and well placement as in Scenario 9 but with a perforation configuration as listed in Table 6 but with ICV 360*a*-360*d* controls at each set of perforations. Each horizontal producing well having five transversally oriented 500 ft half-length NCBF 370*a*-370*e*, 470*a*-470*e* spaced according to the configuration in Table 6. As water breakthrough occurred in each interval the perforations were eliminated to simulate the closing of ICV's 360*a*-360*d*, 460*a*-460*d*.

Results—Dual Horizontal Producers with Single Horizontal Injector—Scenarios 7 Through 10

Figure 21:
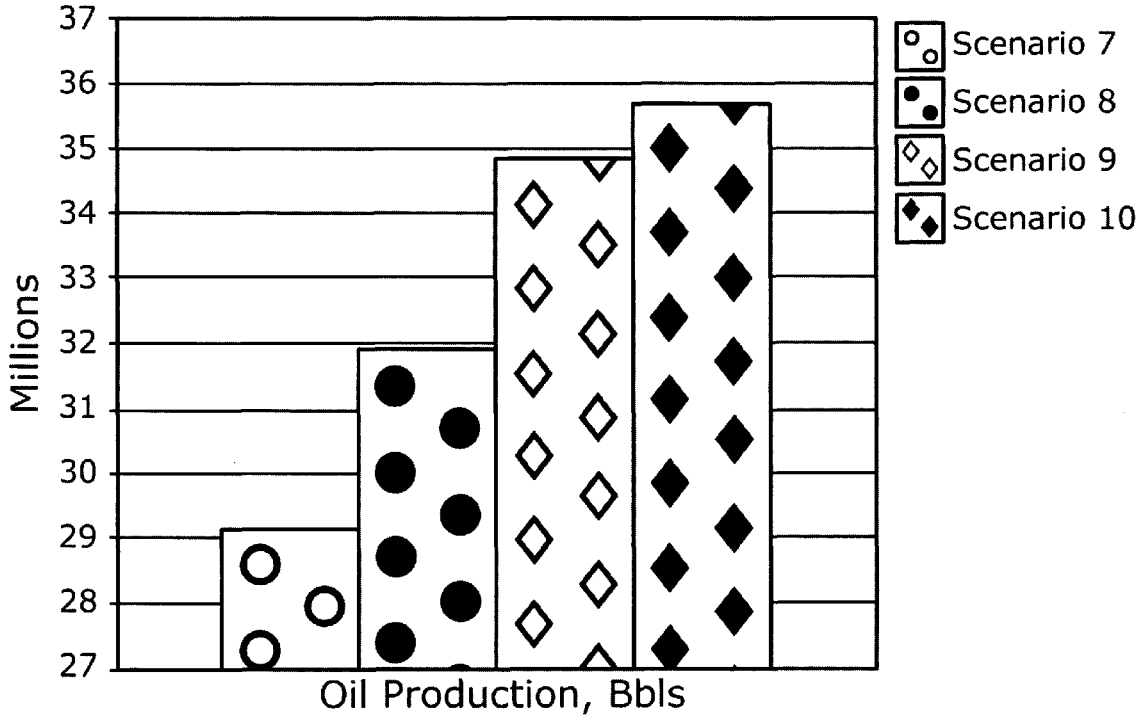
FIG. 21 is a graph of cumulative oil production of various well configuration scenarios.
Figure 22:
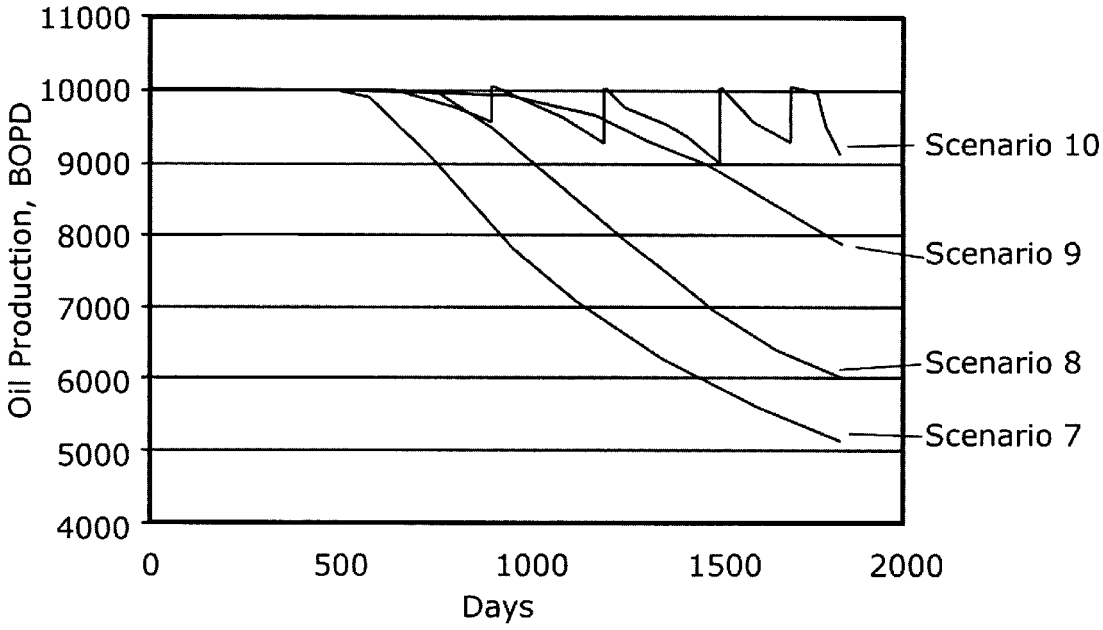
FIG. 22 is a graph of oil production rates from various well configuration scenarios.

The perforation configurations for scenarios 7, 8, 9, and 10 are shown in Table 6. The cumulative results combine production from the two producers. Referring to FIG. 21, the cumulative oil production for the five-year production period varied from 29,150,265 bbls for Scenario 7 base case with no inflow controls to 35,715,900 bbls for Scenario 10 with 5 NCBF and ICV's controls—an improvement of 22.5% with an increment oil recovery of 6,565,634 bbls. The benefit to the daily oil production rates for scenarios 7 through 10 is illustrated in FIG. 22. The effect of the use of ICV's in Scenario 10 is evident in the sudden increase in oil production as each set of perforations is closed.

Figure 23:
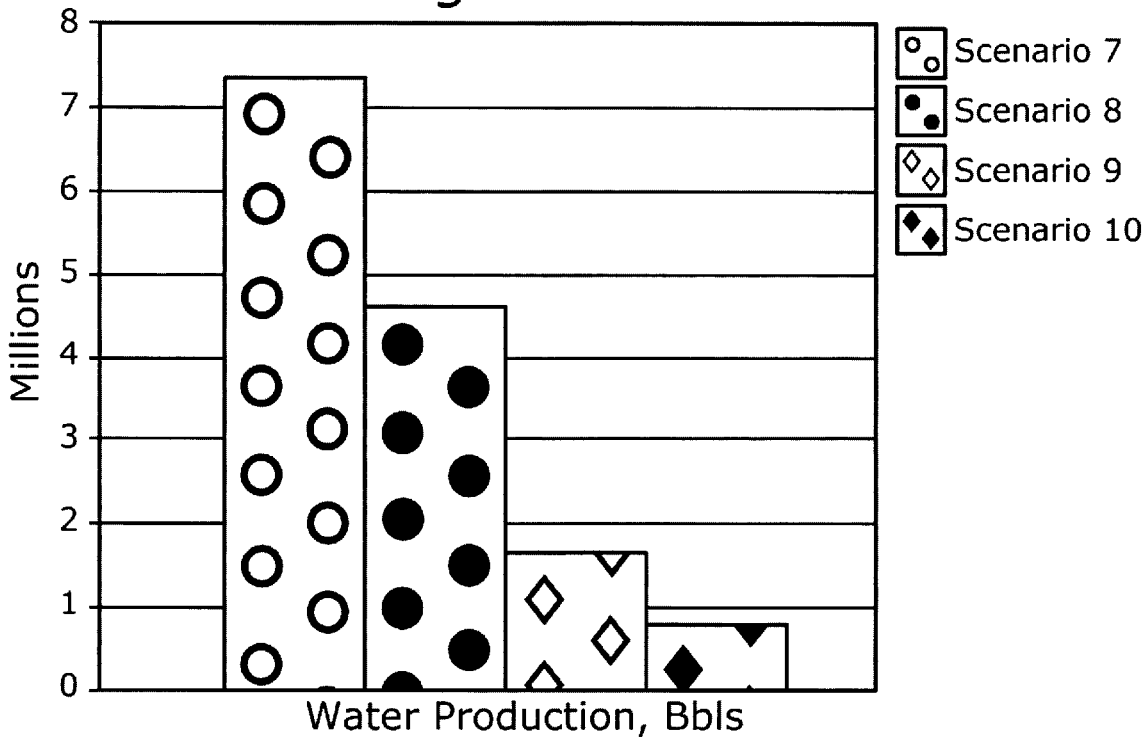
FIG. 23 is a graph of cumulative water production of various well configuration scenarios.
Figure 24:
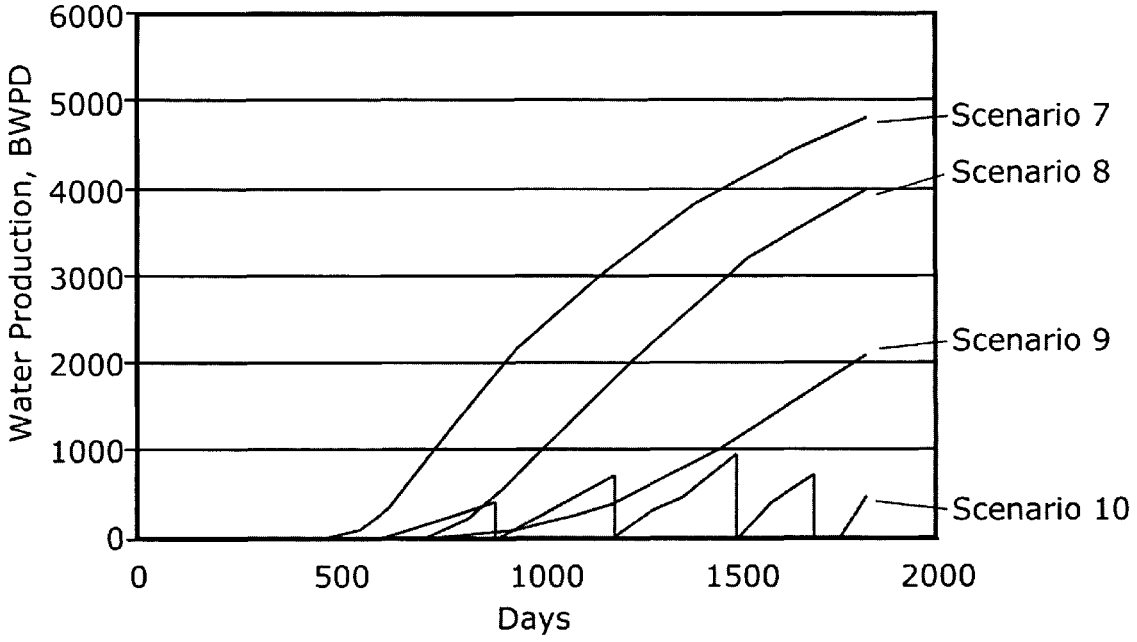
FIG. 24 is a graph of water production rates from various well configuration scenarios.

Referring to FIG. 23, the cumulative water production for the five-year production period with 20,000 bwpd water injection varied from 7,374,735 bbls for Scenario 7 base case with no inflow controls to 777,970 bbls for Scenario 10 with 5 NCBF and ICV's controls—a reduction of 6,596,765 bbls of produced water. The timing of the floodfront water breakthrough and control of water production can be determined for each scenario as illustrated in FIG. 24. The effect of the use of ICV's in Scenario 10 is evident in the sudden decrease in water production as each set of perforations is closed.

Summary of Simulation Results

Using the cumulative production from Scenario 1 (for the single horizontal producer case) and Scenario 7 (for the Dual Horizontal producers case) as the base cases for the simulations, the value of inflow controls used in conjunction with one or more NCBF are shown in terms of improved oil recovery, incremental oil, and reduced water production in Table 7.

TABLE 7

Summary of Results

| Scenario | % Improved Oil Recovery | Incremental Oil Recovered | Reduction in Produced Water |
|---|---|---|---|
| Single Horizontal Producer Case | | | |
| 1 | Base Case | Base Case | Base Case |
| 2 | 10.3% | 3,033,447 bbls | 3,033,448 bbls |
| 3 | 16.1% | 4,739,505 bbls | 4,739,510 bbls |
| 4 | 12.9% | 3,810,409 bbls | 3,810,409 bbls |
| 5 | 20.6% | 6,081,986 bbls | 6,081,986 bbls |
| 6 | 23.4% | 6,906,023 bbls | 6,906,023 bbls |
| Dual Horizontal Producer Case | | | |
| 7 | Base Case | Base Case | Base Case |
| 8 | 9.4% | 2,752,604 bbls | 2,752,604 bbls |
| 9 | 19.6% | 5,715,246 bbls | 5,715,246 bbls |
| 10 | 22.5% | 6,565,634 bbls | 6,596,765 bbls |

Horizontal producers with Inflow Controls and NCBF are shown through reservoir simulation to improve the recovery of oil and reduce the production of water in a waterflood. In simulations of a single horizontal producer and single vertical injector, the combination of both ICD and NCBF usage resulted in a significant improvement above the base case, as shown by Scenarios 5 and 6 in Table 7. The optimum result was for Scenario 6 that utilized ICD, ICV, and NCBF usage. In simulations of dual horizontal producers and single horizontal injector, the combination of both ICD and NCBF usage also resulted in an improvement above the base case, as shown by Scenarios 8, 9, and 10 in Table 7.

A further aspect of the present invention is a method of reservoir simulation to predict and evaluate the oil and non-hydrocarbon production and flood front progression over time while utilizing the various combinations of barrier fractures and inflow control devices/valves. The combination of ICD's, ICV's and NCBF can yield greater efficiency in flooding oil reservoirs than by these controls individually. Through reservoir simulation of various completion scenarios the value of these controls can be evaluated. The use of reservoir simulation is also important in optimizing the placement and number of these controls for a given completion.

Figure 25:
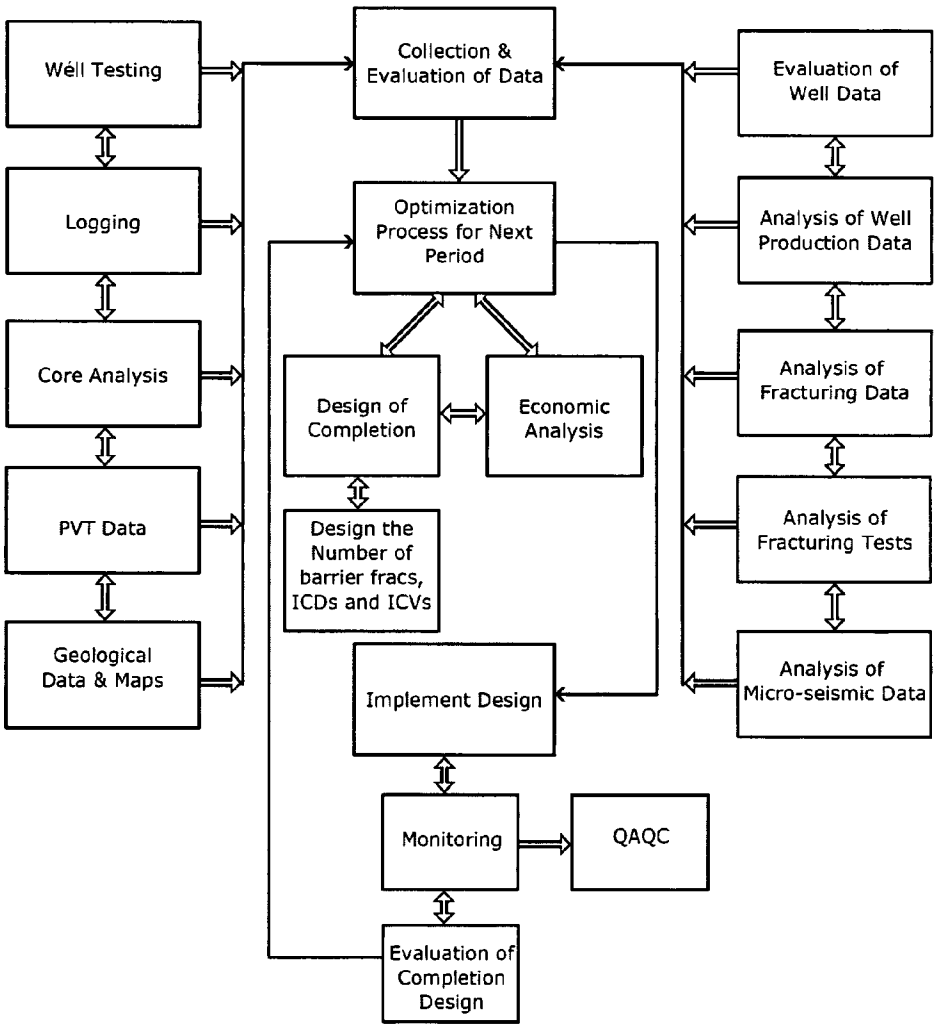
FIG. 25 is a flow chart of an optimization process utilizing numerical simulation of various completion scenarios.

The optimization process can include a number of differing aspects such as those listed in the non-limiting embodiment below:

- Determine the stress field of the formation. This can include both the magnitude and the orientation of the stress.
- Design the completion such that the production horizontal well is in the direction of the minimum horizontal stress, thus the created fractures would be transverse to the wellbore. The injection well is optionally a vertical well and is drilled in same orientation. The injection well could be also horizontal. The injection horizontal well may be drilled either in direction of minimum or maximum stress. It is also possible to use one horizontal well to accomplish both production and injection by producing from one part of the well while injecting into another.
- Build a realistic reservoir model that incorporates:
  - Physical properties of the rock
  - Mechanical properties of the rock
  - Stress field magnitude and orientation
- Verify the model
- Build a reservoir model into a numerical or other type simulator.
- Vary the following parameters to reach an optimum completion:
  - Distance from the tip of the horizontal well to the injection well
  - Number and location of the barrier fractures
  - Number of ICD's/ICV's
  - Injection rate
  - Location of the injection interval
- If the injection well is horizontal the following parameters may be also optimized:
  - The orientation of the horizontal well;
  - The distance between the two horizontal wells
  - The location and type of ICD's/ICV's used in the injection and/or horizontal wells FIG. 25 provides a flow chart of an embodiment of an optimization process utilizing reservoir simulation of various completion scenarios. The flow chart includes job execution and monitoring. This is a dynamic process that involves interaction among multiple functions.

The reservoir model used for analyzing the scenarios provided herein utilized a commercially available simulator QuikLook™ by Halliburton. It was capable of simulating horizontal wellbores having multiple transverse fractures. It had the ability to account for three-phase, four component system (gas, oil, water, and injected fracturing fluid) and have intermittent injection and production flow periods. It further had the ability to account for asymmetric fracture wings with adjustable length, width, height, and conductivity characteristics.

The reservoir simulator was linked to a commercially available numerical wellbore simulator, WellCat™ by Halliburton. The simulator was used to calculate wellbore temperature and pressure profile during the injection of fluids, thus accounting for the cool down of the formation during a sustained injection of flood fluids. The program can model vertical, horizontal, and multilateral wells that may be fractured or not.

While the invention has been depicted, described, and is defined by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. For example, as those of ordinary skill in the art will appreciate, the exact number, size and order of the transverse fractures formed is not critical. The depicted and described embodiments of the invention are exemplary only, and are not exhaustive of the scope of the invention. Consequently, the invention is intended to be limited only by the scope of the appended claims, giving full cognizance to equivalents in all respects.

Depending on the context, all references herein to the "invention" may in some cases refer to certain specific embodiments only. In other cases it may refer to subject matter recited in one or more, but not necessarily all, of the claims. While the foregoing is directed to embodiments, versions and examples of the present invention, which are included to enable a person of ordinary skill in the art to make and use the inventions when the information in this patent is combined with available information and technology, the inventions are not limited to only these particular embodiments, versions and examples. Other and further embodiments, versions and examples of the invention may be devised without departing from the basic scope thereof and the scope thereof is determined by the claims that follow.

While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee.

What is claimed is:

1. A method of hydrocarbon production from a hydrocarbon reservoir comprising:

providing a substantially horizontal wellbore having at least one productive interval within a hydrocarbon reservoir;

forming at least one non-conductive transverse fracture in the reservoir along the substantially horizontal wellbore;

providing an injection well into the reservoir;

injecting a fluid into the reservoir through the injection well to displace hydrocarbons within the reservoir toward the at least one productive interval of the wellbore; and draining hydrocarbons from the reservoir into at least one production interval of the substantially horizontal wellbore;

wherein fluid production from at least one productive interval in the substantially horizontal wellbore flows through an inflow control device that can restrict fluid flow.

2. The method of claim 1, wherein the at least one non-conductive transverse fracture is placed after initial production has begun.

3. The method of claim 1, wherein the inflow control device provides an optimized pressure drop along the production interval through the inflow control device for the volume of fluid flow through the wellbore.

4. The method of claim 1, further comprising closing or sealing of an inflow control device when production from the production interval through the inflow control device reaches an unacceptable level of non-hydrocarbon fluids with the hydrocarbon production.

5. The method of claim 4, further comprising the selective closing or sealing of additional inflow control devices when production from the production intervals associated with such inflow control devices reach an unacceptable level of non-hydrocarbon fluids with the hydrocarbon production.

6. The method of claim 1, wherein the inflow control device contains a valve device that can be closed and restrict the flow from an adjacent production interval into the substantially horizontal wellbore.

7. The method of claim 1, wherein the inflow control device contains a sliding sleeve device that can be closed.

8. The method of claim 1, wherein the inflow control device contains both a flow restriction device and a valve device that can be closed to restrict the flow from an adjacent production interval into the substantially horizontal wellbore.

9. The method of claim 1, wherein a sealant material is used to create the non-conductive transverse fracture.

10. The method of claim 1, further comprising lining the substantially horizontal wellbore with a casing string.

11. The method of claim 10, wherein the casing string is cemented to a sidewall of the substantially horizontal wellbore.

12. The method of claim 10, wherein the casing string incorporates external casing packers to isolate specific intervals of the substantially horizontal wellbore.

13. The method of claim 1, wherein at least one non-conductive transverse fracture is formed using a hydra jetting tool.

14. The method of claim 1, wherein at least one non-conductive transverse fracture is formed by staged fracturing.

15. The method of claim 1, wherein at least one transverse fracture is formed using a limited entry perforation and fracture technique.

16. The method of claim 1, wherein at least one non-conductive transverse fracture is formed using sliding sleeves incorporated on a casing string.

17. The method of claim 1, further comprising installing a device for monitoring the amount of infiltration of the non-hydrocarbon fluid into the hydrocarbons being produced in the substantially horizontal wellbore adjacent to one or more of the production intervals.

18. The method of claim 17, wherein the device for monitoring the amount of infiltration of the non-hydrocarbon fluid comprises a sampling tube ran from the surface to the substantially horizontal wellbore from which samples of the fluid can be taken.

19. The method of claim 1, further comprising closing of an inflow control device adjacent to a productive interval when the amount of non-hydrocarbon fluid infiltrating the hydrocarbons being produced reaches an undesirable value.

20. The method of claim 19, further comprising repeatedly closing of inflow control devices adjacent to production intervals until all but one remaining production interval has been sealed.

21. A method of hydrocarbon production from a hydrocarbon reservoir comprising:

providing at least one substantially horizontal wellbore having at least one productive interval within a hydrocarbon reservoir;

forming at least one non-conductive transverse fracture in the reservoir along the substantially horizontal wellbore;

providing an injection well into the reservoir;

injecting a fluid into the reservoir through the injection well to displace hydrocarbons within the reservoir toward a production interval;

draining hydrocarbons from the reservoir into a productive interval and into the substantially horizontal wellbore through at least one inflow control device that can restrict fluid flow from the production interval;

selectively closing or sealing of an inflow control device when production from the production interval through the inflow control device reaches an unacceptable level of non-hydrocarbon fluids.

22. The method of claim 21, wherein the substantially horizontal wellbore is both a producing well and the injection well.

23. The method of claim 21, wherein there are provided two or more substantially horizontal wellbores within the hydrocarbon reservoir and the injection well is a horizontal injection well within the hydrocarbon reservoir.

* * * * *